US009272867B2

(12) United States Patent
Kaneko

(10) Patent No.: US 9,272,867 B2
(45) Date of Patent: Mar. 1, 2016

(54) SHEET CONVEYANCE DEVICE, IMAGE FORMING SYSTEM AND CONTROL METHOD OF SHEET CONVEYANCE DEVICE

(71) Applicant: Konica Minolta, Inc., Chiyoda-ku, Tokyo (JP)

(72) Inventor: Masahiro Kaneko, Hino (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/608,684

(22) Filed: Jan. 29, 2015

(65) Prior Publication Data

US 2015/0217956 A1 Aug. 6, 2015

(30) Foreign Application Priority Data

Feb. 6, 2014 (JP) ..... 2014-021035

(51) Int. Cl.

| | |
|---|---|
| ***B65H 7/06*** | (2006.01) |
| ***B65H 5/36*** | (2006.01) |
| ***G03G 15/00*** | (2006.01) |
| ***B65H 5/06*** | (2006.01) |
| ***B65H 7/20*** | (2006.01) |
| ***B65H 5/26*** | (2006.01) |

(52) U.S. Cl.

CPC ..... *B65H 7/06* (2013.01); *B65H 5/068* (2013.01); *B65H 5/26* (2013.01); *B65H 5/36* (2013.01); *B65H 7/20* (2013.01); *G03G 15/70* (2013.01); *B65H 2511/528* (2013.01); *B65H 2601/11* (2013.01); *G03G 2215/00552* (2013.01)

(58) Field of Classification Search

CPC ..... B65H 7/00; B65H 7/02; B65H 7/04; B65H 7/06; B65H 7/14; B65H 2511/528; B65H 2601/11; B65H 5/36

USPC ..... 399/21, 20

See application file for complete search history.

(56) References Cited

U.S. PATENT DOCUMENTS

| | | | | |
|---|---|---|---|---|
| 5,328,168 | A * | 7/1994 | Fox | 271/259 |
| 5,727,784 | A * | 3/1998 | Sagawa | 271/265.01 |
| 7,883,087 | B2 * | 2/2011 | Kitano | 271/258.01 |
| 8,260,158 | B2 * | 9/2012 | Goto et al. | 399/20 |
| 8,348,261 | B2 * | 1/2013 | Moriyama | 271/186 |
| 8,908,215 | B2 * | 12/2014 | Kato | 358/1.15 |
| 8,910,940 | B2 * | 12/2014 | Isohara | 271/273 |
| 9,045,297 | B2 * | 6/2015 | Takamori | |
| 2009/0110411 | A1 * | 4/2009 | Gungor et al. | 399/20 |
| 2010/0194026 | A1 * | 8/2010 | Iguchi | 271/3.15 |

FOREIGN PATENT DOCUMENTS

| | | | |
|---|---|---|---|
| JP | 2009018923 | A | 1/2009 |
| JP | 2012143964 | A | 8/2012 |

* cited by examiner

*Primary Examiner* — Patrick Cicchino
(74) *Attorney, Agent, or Firm* — Cantor Colburn LLP

(57) ABSTRACT

At occurrence of jamming, a downstream-side conveying roller pair is stopped, while an upstream-side conveying roller pair continuously rotates, whereby a sheet between the downstream-side conveying roller pair and the upstream-side conveying roller pair is ejected from a sheet conveying path opened by a movable guide portion. At this time, a conveying force of a stepping motor driving the upstream-side conveying roller pair is made larger than the conveying force before the occurrence of jamming.

21 Claims, 15 Drawing Sheets

SHEET CONVEYANCE DEVICE, IMAGE FORMING SYSTEM AND CONTROL METHOD OF SHEET CONVEYANCE DEVICE

CROSS REFERENCES TO RELATED APPLICATIONS

The present invention contains subject matter related to Japanese Patent Application JP 2014-021035, filed in the Japanese Patent Office on Feb. 6, 2014, the entire content of which being incorporated herein by reference.

BACKGROUND OF THE INVENTION

1. Field of the Invention

The present invention relates to a tandem image forming system in which a plurality of image forming apparatuses are serially connected, a sheet conveying device arranged between the image forming apparatuses, and a control method of the sheet conveying device.

2. Description of the Related Art

A tandem image forming system constituted by serially connecting two image forming apparatuses (hereinafter referred to simply as an "image forming system") is known. According to the image forming system, when an image is to be formed on both surfaces of a sheet, an image is formed on the front surface of the sheet by the upstream image forming apparatus, and an image can be formed on the back surface of the sheet by the downstream image forming apparatus, for example. By sharing processing for forming images on the front surface and the back surface of the sheet by the respective image forming apparatuses, productivity can be improved as compared with formation of images on the both surfaces of the sheet with one image forming apparatus (see Japanese Patent Laid-Open No. 2012-143964).

In such type of the image forming system, a sheet conveying device might be arranged between the two image forming apparatuses. In the image forming system provided with the sheet conveying device, at occurrence of jamming, a work of removing the sheet in the sheet conveying device or the sheet conveyed to the sheet conveying device from the image forming apparatus arranged on the upstream side of the sheet conveying device is performed. Therefore, in such type of the sheet conveying device, a technology for removing the sheet easily is in demand.

On the other hand, a configuration has been proposed that the sheet conveying device is provided with a guide portion for opening a conveying path between two conveying rollers, and if jamming occurs, the guide portion is opened so as to eject the sheet being conveyed to an outside of the sheet conveying path (see Japanese Patent Laid-Open No. 2009-18923). In Japanese Patent Laid-Open No. 2009-18923, the sheet conveying device is configured to deflect the sheet by stopping or reverse feeding later the conveying roller on the downstream side and continuously forward feeding the conveying roller on the upstream side and to open the guide portion by pressing of the deflected sheet. As a result, the jammed sheet is automatically ejected to the outside of the sheet conveying path.

SUMMARY OF THE INVENTION

As described above, if the sheet is to be automatically ejected to the outside of the sheet conveying path in the sheet conveying device, there is a demand that as many sheets as possible are to be ejected to the outside of the sheet conveying path in order to improve efficiency of the removing work. In response, as many sheets as possible can be ejected to the outside of the sheet conveying path by immediately stopping the conveying roller on the downstream side of the sheet conveying device and by continuously rotating the conveying roller on the upstream side at occurrence of jamming.

However, if only the conveying roller on the downstream side is stopped in a state in which the sheet is nipped by the downstream-side conveying roller and the upstream-side conveying roller at the same time, the sheet being conveyed is rapidly stopped, and a force in a direction opposite to a conveying direction of the sheet is applied by the sheet to the upstream-side conveying roller. Since the upstream-side conveying roller continuously rotating at the time, the force is transmitted to a conveying motor for rotating/driving the upstream-side conveying roller, and a rapid load is applied to the conveying motor.

On the other hand, employment of a stepping motor as a conveying motor for improvement of conveying accuracy is required, but if a rapid load is applied to the stepping motor, there is a concern that the stepping motor goes out of step. Therefore, if the stepping motor is used as the conveying motor for driving the upstream-side conveying roller, when the downstream-side conveying roller is stopped, a rapid load is applied to the conveying motor for driving the upstream-side conveying roller, and nonconformity that the conveying motor goes out of step occurs.

An object of the present invention is to provide a sheet conveying device which can easily eject the sheet to the outside of the sheet conveying path at occurrence of jamming and can prevent out-of-step of the conveying motor and an image forming system provided with the sheet conveying device. Moreover, another object of the present invention is to provide a control method of the sheet conveying device.

To solve the above-described problems and to achieve at least one of the above-described objects according to one aspect of the present invention, a sheet conveying device reflecting one aspect of the present invention comprises a plurality of conveying roller pairs provided along a sheet conveying path, a movable guide portion, and a control portion. The plurality of conveying roller pairs includes a downstream-side conveying roller pair whose rotation is stopped at occurrence of jamming and an upstream-side conveying roller pair provided on an upstream side of the downstream-side conveying roller pair and continuously rotating at occurrence of jamming. The movable guide portion opens the sheet conveying path by moving one of rollers of at least the downstream-side conveying roller pair in the plurality of conveying roller pairs in a direction away from the sheet conveying path. The control portion stops the downstream-side conveying roller pair in the plurality of conveying roller pairs and controls such that a conveying force for conveying a sheet of a stepping motor driving the upstream-side conveying roller pair is larger than the conveying force before the downstream-side conveying roller pair is stopped.

An image forming system according to one aspect of the present invention includes a first image forming apparatus arranged on an upstream side in a sheet conveying direction, a second image forming apparatus arranged on a downstream side in the sheet conveying direction, and the above-described sheet conveying device arranged between the first image forming apparatus and the second image forming apparatus. The sheet conveying device conveys the sheet conveyed from the first image forming apparatus to the second image forming apparatus.

A control method of the sheet conveying device according to one aspect of the present invention is a control method of a sheet conveying device having: a plurality of conveying roller pairs provided along a sheet conveying path, including a downstream-side conveying roller pair and an upstream-side conveying roller pair provided on the upstream side of the downstream-side conveying roller pair; a movable guide portion for opening the sheet conveying path by moving one of rollers of at least the downstream-side conveying roller pair in the plurality of conveying roller pairs in a direction away from the sheet conveying path; and a control portion for controlling driving of the plurality of conveying roller pairs, in which the control portion stops rotation of the downstream-side conveying roller pair in the plurality of conveying roller pairs at occurrence of jamming and controls such that a conveying force for conveying a sheet of a stepping motor driving the upstream-side conveying roller pair is larger than the conveying force before the rotation of the downstream-side conveying roller pair is stopped.

In the sheet conveying device, the control method of the sheet conveying device, and the image forming system according to one aspect of the present invention, at occurrence of jamming, the downstream-side conveying roller pair is stopped, while the upstream-side conveying roller pair continuously rotating and thus, the sheet between the downstream-side conveying roller pair and the upstream-side conveying roller pair is ejected from the sheet conveying path opened by the movable guide portion. At the time, by increasing the conveying force of the stepping motor driving the upstream conveying roller pair, a force against a rapid load applied to the stepping motor can be improved.

According to the present invention, even if the conveying motor is constituted by a stepping motor, out-of-step of the stepping motor can be prevented at sheet ejection at occurrence of jamming.

DESCRIPTION OF THE PREFERRED EMBODIMENTS

An example of an image forming system, a sheet conveying device, and a control method of the sheet conveying device according to embodiments of the present invention will be described by referring to the attached drawings. The present invention is not limited to the following examples. The embodiments of the present invention will be described in the following order:

1. First embodiment: image forming system
1-1. Entire configuration of image forming system
1-2. Unlock operation of automatic opening/closing mechanism
1-3. Internal configuration of image forming system
1-4. Operation in jamming processing
2. Second embodiment: image forming system
3. Third embodiment: image forming system

1. First Embodiment

Image Forming System

<1-1. Entire Configuration of Image Forming System>

Figure 1:
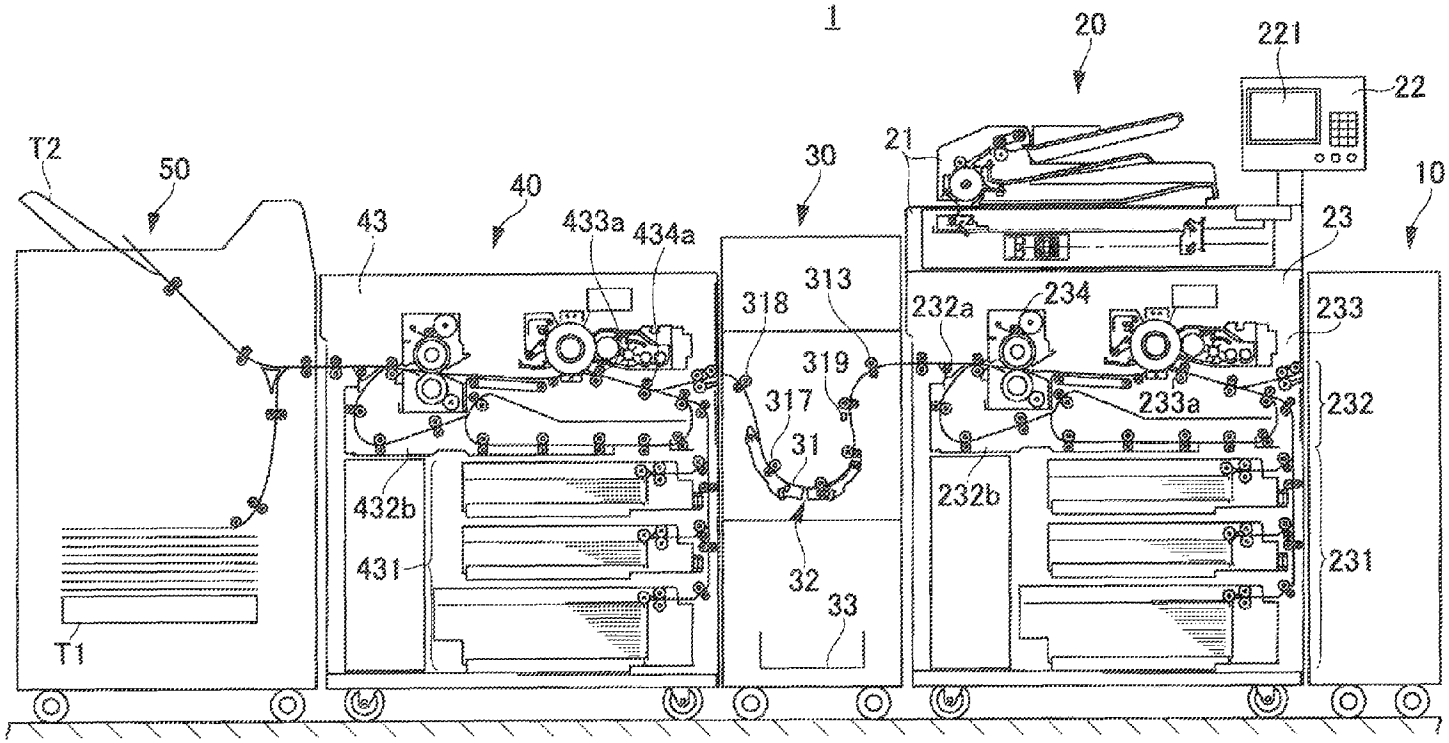
FIG. 1 is an outline view illustrating an entire configuration of an image forming system according to a first embodiment of the present invention.

First, an outline of an image forming system according to a first embodiment of the present invention will be described by referring to FIG. 1. FIG. 1 is an outline view illustrating an entire configuration of the image forming system according to the first embodiment of the present invention.

As illustrated in FIG. 1, the image forming system 1 has a serial tandem configuration in which a paper feeding device 10, a first image forming apparatus 20, a sheet conveying device 30, a second image forming apparatus 40, a post-processing device 50 and the like are connected serially from an upstream side of a sheet conveying path.

The first image forming apparatus 20 and the second image forming apparatus 40 are set to be either of a main machine integrally managing the image forming system 1 and a sub machine operated in accordance with an instruction of the main machine when they are connected. In the embodiment, it is assumed that the first image forming apparatus 20 provided on the upstream side in the sheet conveying direction is set to be a main machine and the second image forming apparatus 40 to be a sub machine.

In the image forming system 1 in the embodiment, when a job in a double-side mode in which an image is formed on the both surfaces of a sheet is to be performed, the first image forming apparatus 20 functions as a first image forming apparatus performing image formation on one of surfaces of the sheet, while the second image forming apparatus 40 functions as a second image forming apparatus performing image formation on the other surface of the sheet.

When the job in the double-side mode is to be performed, the first image forming apparatus 20 forms an image on the front surface of the sheet having been conveyed from the paper feeding device 10 or a paper feeding portion in the first image forming apparatus 20. Then, the sheet with the image formed on the front surface of the sheet is inverted by a inverting portion in the first image forming apparatus 20 and then, passes through the sheet conveying device 30 and is conveyed to the second image forming apparatus 40, and an image is formed on the back surface of the sheet, and then, the sheet is conveyed to the post-processing device 50.

Moreover, when a job on a single-side mode in which an image is formed on one surface of the sheet is to be performed, the first image forming apparatus 20 forms an image on one of the surfaces of the sheet having been conveyed from the paper feeding device 10 or the paper feeding portion in the first image forming apparatus 20. Then, the sheet with the image formed on one surface passes through the sheet conveying device 30 and the second image forming apparatus 40 and is conveyed to the post-processing device 50.

[Paper Feeding Device]

The paper feeding device 10 is called PFU (Paper Feed Unit) and includes a plurality of paper feeding trays, paper feeding unit having a paper feeding roller and a separating roller, a paper feeding/separating rubber, a feeding roller and the like. In each of the paper feeding trays, sheets identified in advance for each type of sheets (paper type, basis weight, sheet size and the like) are stored, and the sheets are conveyed by the paper feeding unit from the uppermost portion one by one to the sheet conveying portion of the first image forming apparatus 20. Information on the type of the sheets (sheet size, paper type and the like) stored in each of the paper feeding trays is stored in nonvolatile memory 251 which will be described later of the first image forming apparatus 20. The paper feeding device 10 functions as the paper feeding portion of the first image forming apparatus 20.

[First Image Forming Apparatus]

The first image forming apparatus 20 reads out an image from a document and forms the read-out image on a sheet. Moreover, it receives print data in page description language formats including a PDL (Page Description Language) format and a Tiff format and print setting data from an external device or the like and forms images on the sheet on the basis of the received print data and print setting data and the like. The first image forming apparatus 20 includes an image reading portion 21, an operation display portion 22, a print portion 23 and the like.

The image reading portion 21 includes an automatic document feeding portion called ADF (Auto Document Feeder) and a reading portion and reads out images on a plurality of documents on the basis of setting information received by the operation display portion 22. The document placed on a document tray of the automatic document feeding portion is conveyed to a contact glass which is a reading location. In the reading portion, the image on the document having been conveyed to the contact glass is read out, and an image signal is generated. Specifically, the image on the document is irradiated with a light source, and its reflective light forms an image on a light receiving surface of an image pickup element 211 (see FIG. 9) which will be described later through an optical system. The image pickup element 211 photoelectrically converts the incident light to a predetermined image signal and outputs it. The output image signal is A/D converted, and image data is created. Here, the image includes not only figures, photos and the like but also text data such as characters and symbols. As the image pickup element 211, CCD (Charge Coupled Device) and CMOS (Complementary Metal-Oxide Semiconductor) can be used.

The operation display portion 22 is constituted by an LCD (Liquid Crystal Display) 221, a touch panel provided so as to cover the LCD 221, various switches, buttons, ten keys, operations key groups and the like. The operation display portion 22 receives an instruction from a user and outputs its operation signal to a control portion 250 (see FIG. 9) which will be described later. Moreover, an operation screen for displaying various setting screens for input of various operation instructions and setting information and various processing results and the like in accordance with a display signal input from the control portion 250 is displayed on the LCD 221.

The print portion 23 is to execute electrophotography type image forming processing and includes portions relating to print output such as a paper feeding portion 231, a sheet conveying portion 232, an image forming portion 233, a fixation portion 234 and the like. In the print portion 23 of the embodiment, an example in which the electrophotography type is applied will be described, but this is not limiting, and other print types such as an inkjet type, a thermal sublimation type and the like may be applied.

The paper feeding portion 231 includes a plurality of paper feeding trays and paper feeding unit having a paper feeding roller, a separating roller, a paper feeding/separating rubber, a feeding roller and the like provided in each of the paper feeding trays. Sheets identified in advance for the type of sheets (paper type, basis weight, sheet size and the like) and that can be fed are stored in each of the paper feeding trays, and the sheets are conveyed by the paper feeding unit from the uppermost portion one by one toward the sheet conveying portion. Information of the type of the sheets (paper type, basis weight, sheet size and the like) stored in each of the paper feeding trays is stored in the nonvolatile memory 251 (see FIG. 9).

The sheet conveying portion 232 conveys the sheet from the paper feeding device 10 or the paper feeding portion 231 to the image forming portion 233. Then, the sheet on which an image is formed in the image forming portion 233 is further conveyed by the sheet conveying portion 232 to the second image forming apparatus 40 side. In the sheet conveying portion 232, the sheet stands by once on an upstream side of a resist roller 233*a* performing skewing correction, and conveyance to a downstream side of the resist roller 233*a* is resumed in accordance with image forming timing.

Moreover, the sheet conveying portion 232 includes an inverting portion 232*b* constituted by a conveying-path switching portion 232*a*, an inverting roller and the like. The portion 232*b* conveys the sheet having passed through the fixation portion 234 to a device connected on the downstream side without inverting the front and rear of the sheet or conveys the sheet to the device connected to the downstream side after inverting the front and rear of the sheet through switchback by the inverting roller and the like in accordance with the switching operation of the conveying path switching portion 232*a*. Moreover, the inverting portion 232*b* may include a circulation path portion for inverting the front and rear of the sheet having passed through the fixation portion 234 and feeding it again to the image forming portion 233 of the first image forming apparatus 20.

The image forming portion 233 includes a photosensitive drum, a charging device, an exposure device, a development device, a transfer device, a cleaning device and the like and forms an image on the sheet surface on the basis of the print image data. If the first image forming apparatus 20 is to form a color image, the image forming portions 233 are provided for each color (Y, M, C, Bk).

In the image forming portion 233, the surface of the photosensitive drum charged by the charging device is irradiated with light according to print image data from the exposure device, and an electrostatic latent image is written. Then, the electrostatic latent image is developed by the development device by making a charged toner adhere to the surface of the photosensitive drum on which the electrostatic latent image is written. The toner image adhering onto the photosensitive drum is transferred to the transfer position to the sheet. After the toner image is transferred to the sheet, remaining charges, remaining toners and the like on the surface of the photosensitive drum are removed by the cleaning device, and the removed toners and the like are collected into a toner collecting container.

The fixation portion 234 is constituted by a fixation heater, a fixation roller, a fixation external heating portion and the like and thermally fixes the toner image transferred to the sheet.

[Sheet Conveying Device]

The sheet conveying device 30 is installed on the downstream side of the first image forming apparatus 20 and on the upstream side of the second image forming apparatus 40 in the sheet conveying direction. In the embodiment, the sheet conveying device 30 conveys the sheet having been conveyed from the first image forming apparatus 20 to the second image forming apparatus 40 in accordance with an instruction from the second image forming apparatus 40.

The sheet conveying device 30 includes a sheet conveying path 31, an automatic path opening mechanism 32, a concentration sensor 319, and a nip-state detection sensor (not shown). The sheet conveying path 31 conveys the sheet having been conveyed from the first image forming apparatus 20 to the second image forming apparatus 40. The automatic path opening mechanism 32 automatically opens/closes the sheet conveying path 31 at occurrence of jamming and ejects (purges) the sheet in the sheet conveying device 30 and the first image forming apparatus 20. In the following explanation, the ejecting operation of the sheet using the automatic path opening mechanism 32 at occurrence of jamming is referred to as a "purge operation" and the purged sheet as a "purge target sheet". Detailed configurations of the sheet conveying path 31 and the automatic path opening mechanism 32 will be described later.

The concentration sensor 319 measures concentration of an image formed on the sheet being conveyed. The nip-state detection sensor detects whether a fifth conveying roller pair 317 changed by opening/closing of the automatic path opening mechanism 32 which will be described later is in pressure contact or not.

If the sheet is stopped in a state in which the sheet is extended over both the first image forming apparatus 20 and the second image forming apparatus 40, the both image forming apparatuses need to be controlled at the same time such that the both image forming apparatuses are made to standby or the like, whereby control becomes complicated. Thus, the sheet conveying path 31 of the sheet conveying device 30 is configured to be longer than a length of the sheet in the conveying direction.

Detailed description of the length required for the sheet conveying path 31 will be found in the following example. First, if a sheet stop position is provided in the middle of the sheet conveying path of the second image forming apparatus 40, the length of the sheet conveying path 31 is set so that the rear end of the sheet is accommodated in the sheet conveying device 30 with a leading end of the sheet stopped in the second image forming apparatus 40 as a base point. Secondly, if the sheet stop position is provided in the middle of the sheet conveying path 31 of the sheet conveying device 30, the length of the sheet conveying path 31 is set so that the rear end of the sheet is accommodated in the sheet conveying device 30 with the leading end of the sheet stopped in the sheet conveying device 30 as the base point. If the sheet leading end stops at a first conveying roller pair 313, for example, the sheet might be extended to the first image forming apparatus 20, and the sheet may not be accommodated in the sheet conveying device 30 in some cases as above depending on the condition.

Figure 2:
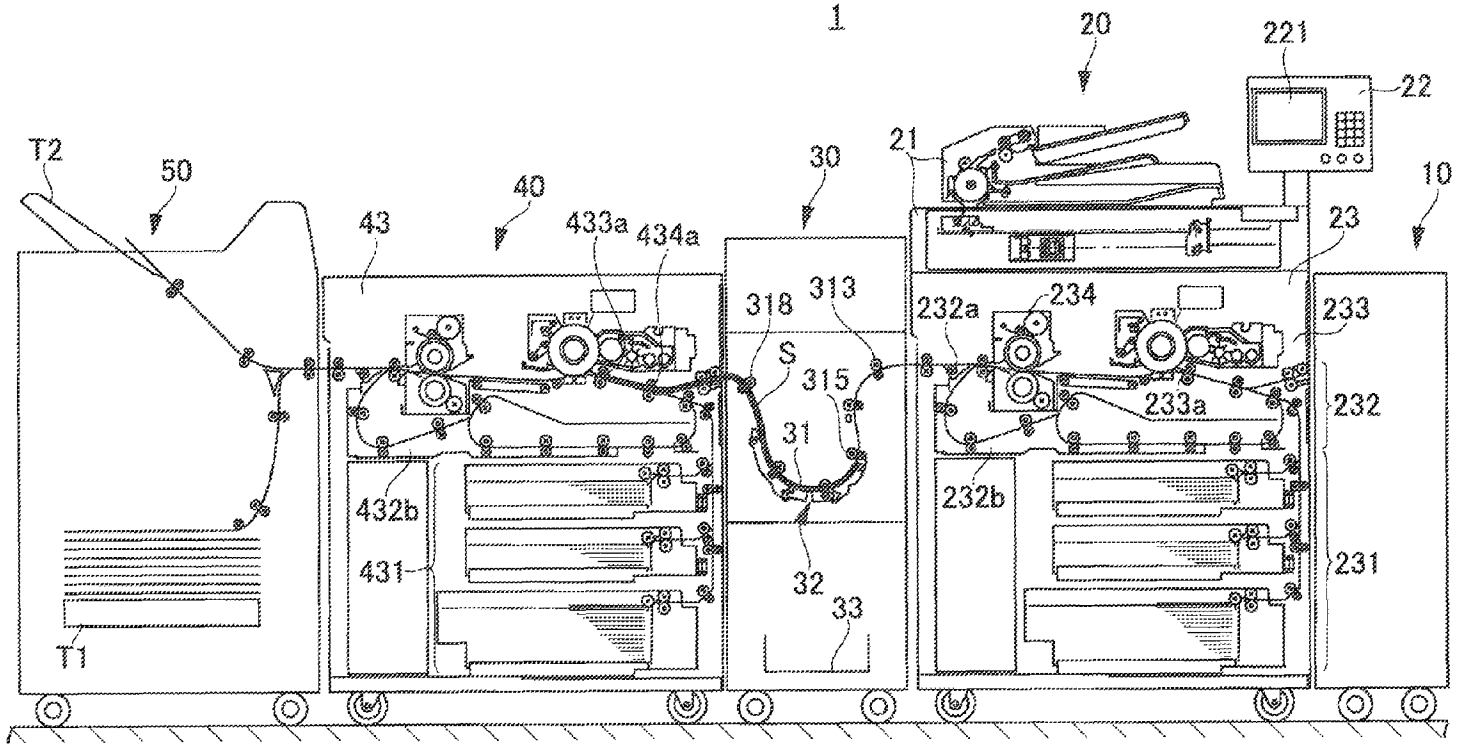
FIG. 2 is an explanatory view illustrating a relationship (first example) between a sheet stop position and a sheet conveying path of a sheet conveying device.

FIG. 2 is an explanatory view illustrating a relationship (first example) between the sheet stop position and the sheet conveying path 31 of the sheet conveying device 30. In the example in FIG. 2, a resist roller 433*a* of the second image forming apparatus 40 is made the sheet stop position. In such case, regarding the length of the sheet conveying path 31, a nip portion of the resist roller 433*a* of the second image forming apparatus 40 is formed so that the rear end of the sheet S is accommodated in the sheet conveying device 30 with the leading end of the sheet S as the base point. The rear end of the sheet S is located in the middle of the sheet conveying path 30 of the sheet conveying device 31 or close to a third conveying roller pair 315 which will be described later, for example.

Figure 3:
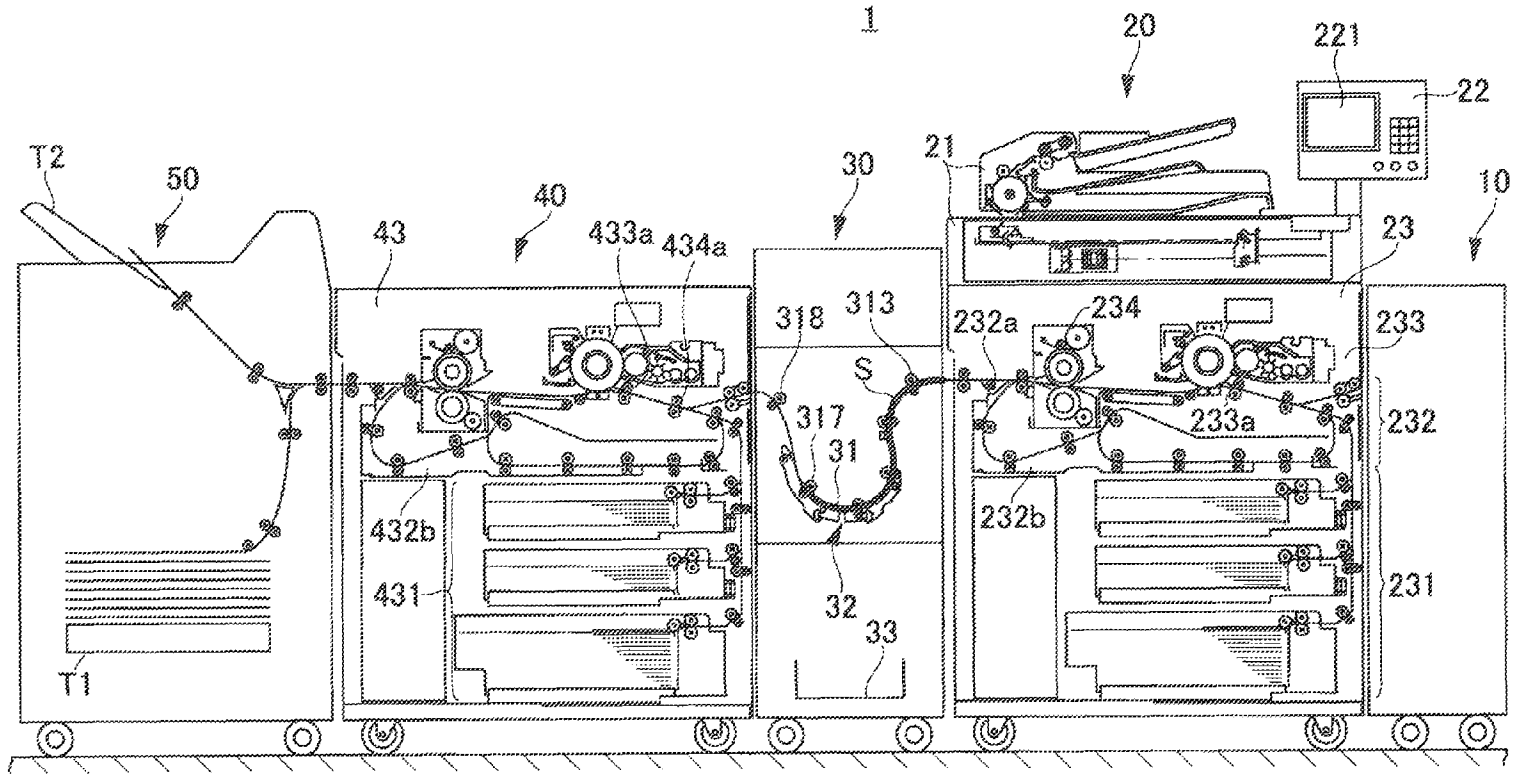
FIG. 3 is an explanatory view illustrating a relationship (second example) between a maximum length of a sheet in a feeding direction and a sheet conveying path of a sheet conveying device.

FIG. 3 is an explanatory view illustrating a relationship (second example) between the maximum length in the sheet feeding direction and the sheet conveying path 31 of the sheet conveying device 30. In the example in FIG. 3, the fifth conveying roller pair 317 of the sheet conveying device 30 is made the sheet stop position. In such case, regarding the length of the sheet conveying path 31, the nip portion of the fifth conveying roller pair 317 of the sheet conveying device 30 is formed so that the rear end of the sheet S is accommodated in the sheet conveying device 30 with the leading end of the sheet S as the base point. The rear end of the sheet S is located close to the first conveying roller pair 313 on a sheet conveying-in side of the sheet conveying path 31 of the sheet conveying device 30. The relationship between the maximum length in the sheet feeding direction and the sheet conveying path 31 of the sheet conveying device 30 is not limited to that and the sheet can be extended to the first image forming apparatus 20 depending on the length of the sheet.

As described above, by making the length of the sheet conveying path 31 longer than the length of the sheet in the conveying direction, even if the sheet is stopped in the sheet conveying device 30, the sheet can be kept in the state extended only at least to one of the image forming apparatuses. As a result, when the sheet is stopped, the image forming apparatus in which the sheet is not stopped in the first image forming apparatus 20 and the second image forming apparatus 40 does not have to be made to standby, and control of the first image forming apparatus 20 and the second image forming apparatus 40 can be made easy.

Moreover, in the embodiment, the sheet conveying path 31 is constituted so as to be curved from the vicinity of the first conveying roller pair 313 on the sheet conveying-in side to the vicinity of a sixth conveying roller pair 318 provided at a position the closest on the sheet ejection side when seen from the front side of the sheet conveying device 30. In the embodiment, the curved shape of the sheet conveying path 31 is substantially a U-shape projecting downward. By curving the sheet conveying path 31, the length of the sheet conveying path 31 can be ensured in a limited space. In other words, by curving the sheet conveying path 31, the length of the sheet conveying path 31 is ensured and moreover, the size of the sheet conveying device 30 can be made compact.

Moreover, the sheet conveying device 30 includes the automatic path opening mechanism 32 (one example of a path opening/closing mechanism) opening the sheet conveying path 31 at occurrence of jamming and automatically performing the purge operation. The jamming refers to abnormal stop of the sheet in the image forming system 1 due to some cause, a sheet abnormally stopped in the image forming system 1 is referred to as a jammed sheet, and an act by the user of removing the sheet causing the abnormal stop (jamming sheet) and the sheet (remaining sheet) other than the jamming sheet stopped during the conveying is described as jamming processing. In the embodiment, the purge operation refers to an operation for ejecting the remaining sheet (purge target sheet) in the sheet conveying device 30 and the first image forming apparatus 20 on the upstream thereof at occurrence of jamming on the downstream side of the sheet conveying device 30.

In the sheet conveying device 30, when jamming occurs, the automatic path opening mechanism 32 is configured to open a part of the sheet conveying path 31 so as to accommodate the sheet remaining in the sheet conveying path 31 at occurrence of the jamming in an accommodating portion 33 installed on a lower part. Then, by performing the purge operation and the jamming processing, the operation of the image forming system 1 can be resumed.

[Second Image Forming Apparatus]

The second image forming apparatus 40 includes a print portion 43 and the like and forms an image on the sheet surface in collaboration with the first image forming apparatus 20. The sheet having been conveyed from the first mage forming apparatus 20 is conveyed to the resist roller 433*a* through a conveying roller 434*a*. The sheet stands by once on the upstream side of the resist roller 433*a*, and conveying to the downstream side of the resist roller 433*a* is resumed in accordance with the image forming timing. The print portion 43 provided in the second image forming apparatus 40 includes portions relating to print output such as a sheet conveying portion provided with a paper feeding portion 431 and an inverting portion 432*b*, an image forming portion, a fixation portion and the like similarly to the print portion 23 provided in the first image forming apparatus 20. Since these configurations are the same as those in the first image forming apparatus 20, the explanation will be omitted.

[Post-Processing Device]

The post-processing device 50 is installed on the downstream side of the second image forming apparatus 40 in the sheet conveying direction, includes various post-processing portions such as a sorting portion, a stapling portion, a punch portion, a folding portion and the like and a sheet ejection tray (large-capacity sheet ejection tray T1 and a sub tray T2) and the like, applies various types of post-processing to the sheet having been conveyed from the second image forming apparatus 40 and ejects the sheet to which the post processing has been applied to the large-capacity sheet ejection tray T1 or the sub tray T2. The large-capacity sheet ejection tray T1 has an elevating/moving stage and accommodates a large amount of sheets in a stacked state on the stage. In the sub tray T2, the sheet is exposed to the outside and ejected in a state capable of visual inspection.

[Configuration of Essential Portion of Sheet Conveying Path and its Periphery]

Figure 4:
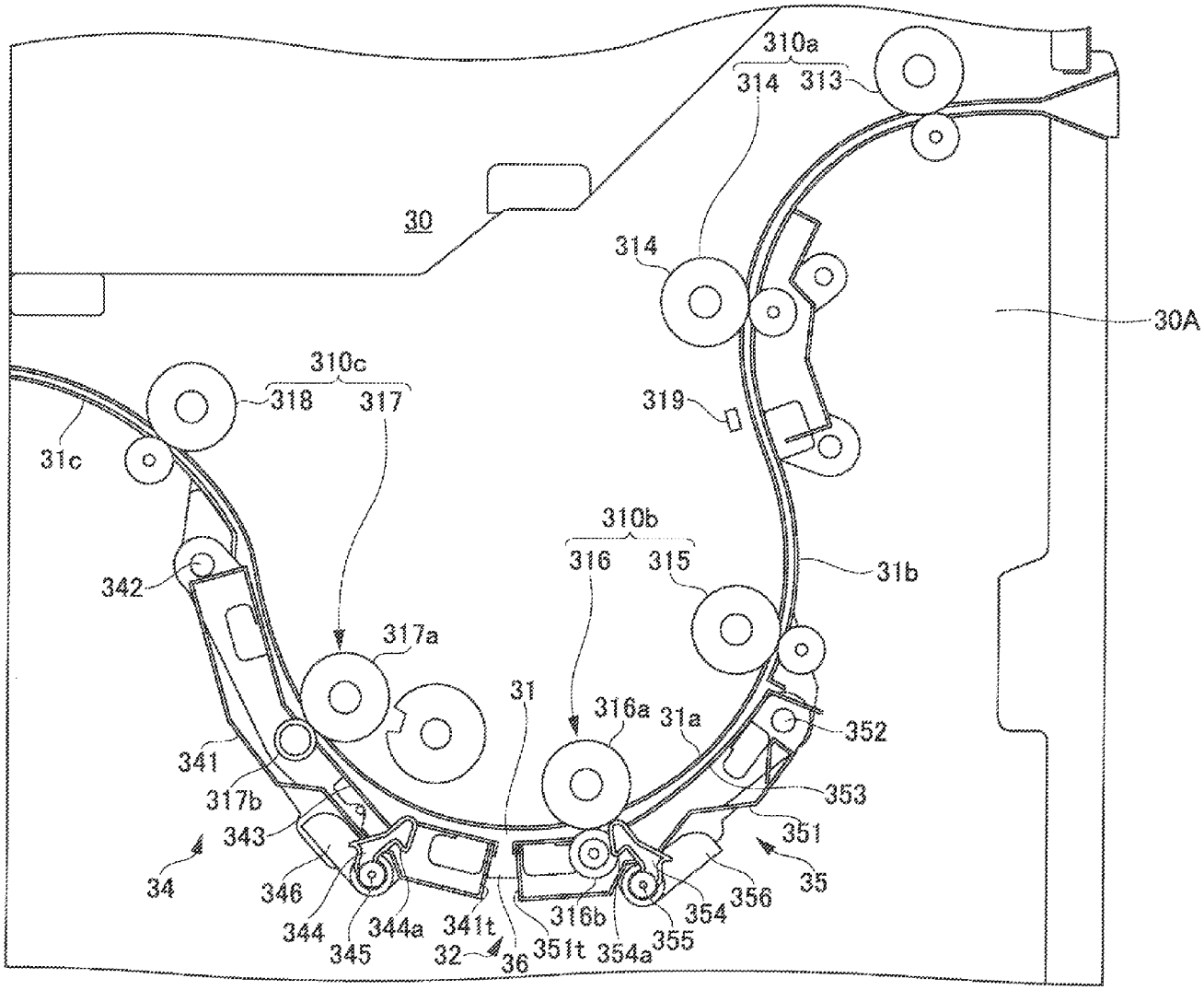
FIG. 4 illustrates a configuration of an essential portion (lock state) of the sheet conveying path when the sheet conveying device is seen from a front.
Figure 5:
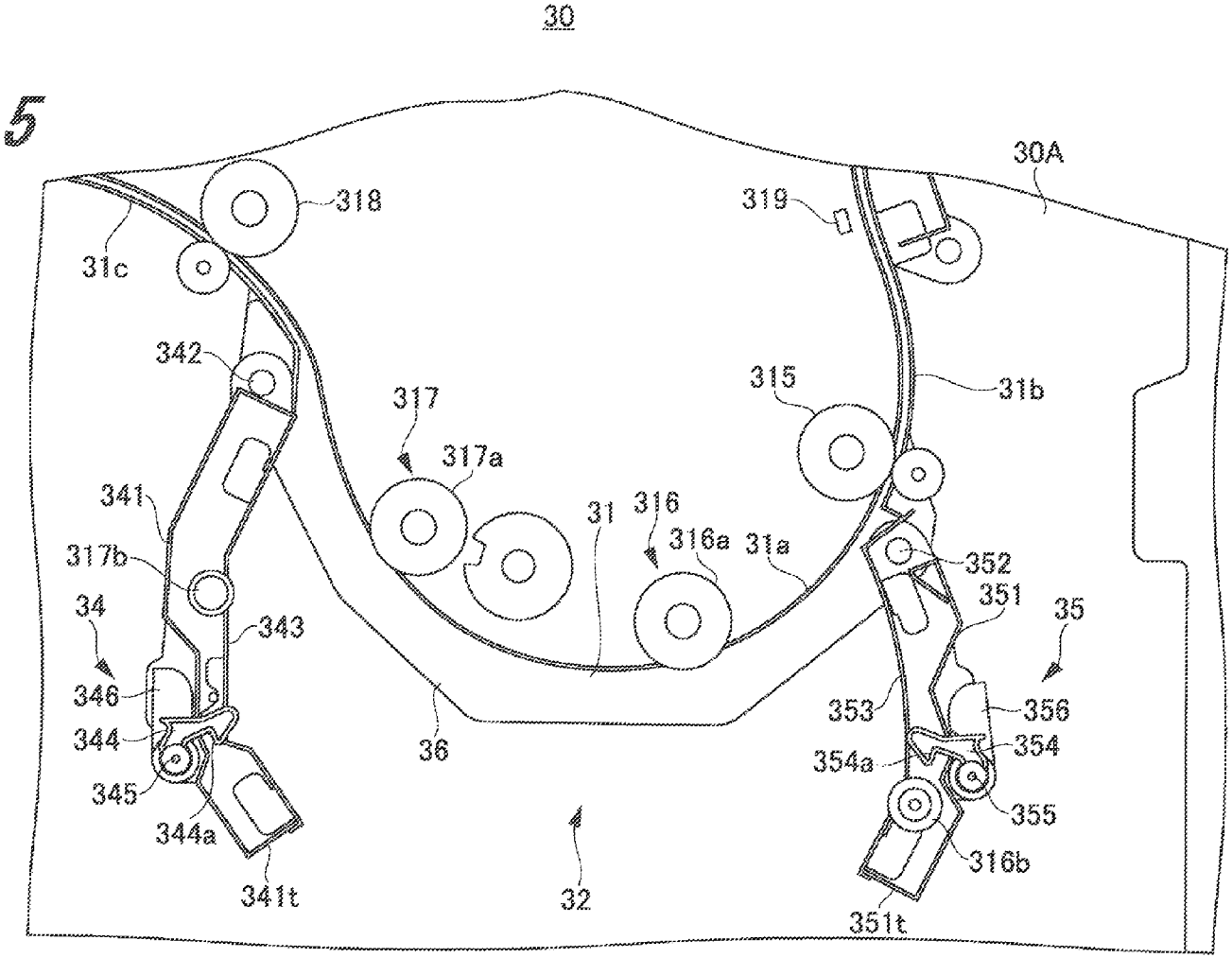
FIG. 5 illustrates a configuration of the essential portion (unlock state) of the sheet conveying path when the sheet conveying device is seen from the front.
Figure 6:
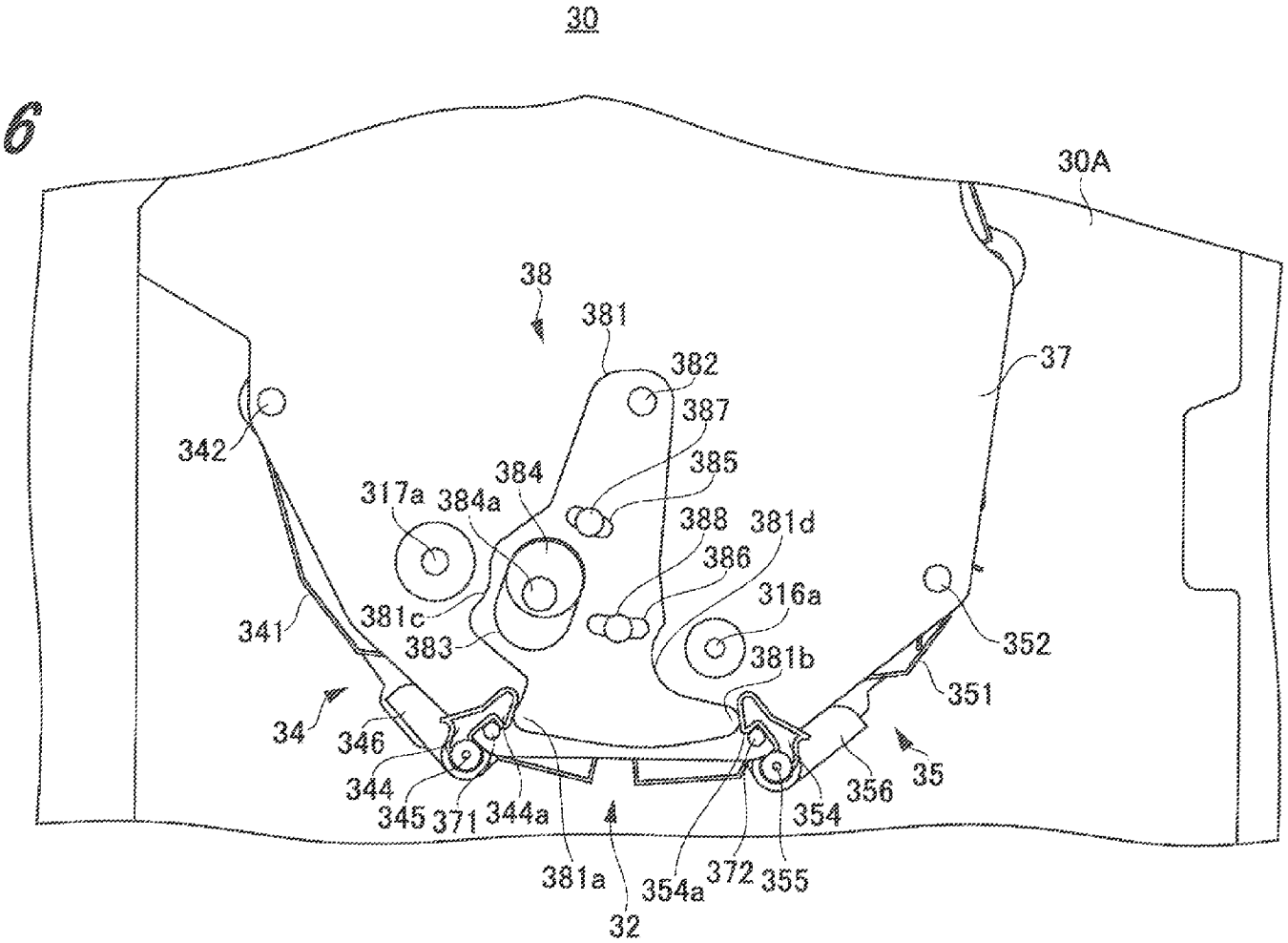
FIG. 6 is a view illustrating a fixed plate provided on a front surface of the sheet conveying path in the sheet conveying device.

Here, the configuration of the automatic path opening mechanism 32 of the sheet conveying device 30 will be further described. FIG. 4 illustrates a configuration of an essential portion (lock state) of the sheet conveying path 31 when the sheet conveying device 30 is seen from the front. FIG. 5 illustrates a configuration of the essential portion (unlock state) of the sheet conveying path 31 when the sheet conveying device 30 is seen from the front. FIG. 6 is a view illustrating a fixed plate 37 provided on a front surface of the sheet conveying path 31 of the sheet conveying device 30. In the embodiment, the fixed plate 37 is provided on the front surface of the sheet conveying path 31 as an example, but it may be so configured that the fixed plate 37 is installed on a rear surface side of the sheet conveying path 31 in order to ensure safety for the user.

As illustrated in FIG. 4, the sheet conveying device 30 includes a sheet conveying path 31 curved downward and the automatic path opening mechanism 32. The sheet conveying path 31 in the sheet conveying device 30 includes an inner guide portion 31*a* having a curved plate shape, fixed guide portions 31*b* and 31*c* each having a curved plate shape provided so as to be faced with the inner guide portion 31*a*, and a first movable guide portion 34 and a second movable guide portion 35 (an example of the movable guide portion of the present invention) rotatable downward.

The first movable guide portion 34 has a first movable guide portion body 341 having a plate-shaped guide portion 343 provided so as to be faced with the inner guide portion 31*a* and a lock mechanism. The second movable guide portion 35 is provided on the upstream side of the first movable guide portion 34 in the sheet conveying direction and has a second movable guide portion body 351 having a plate-shaped guide portion 353 provided so as to be faced with the inner guide portion 31*a* and a lock mechanism. The above-described fixed guide portion 31*b*, the guide portion 353, the guide portion 343, and the fixed guide portion 31*c* are arranged in this order from the upstream side to the downstream side.

The sheet conveying device 30 includes an upstream-side conveying portion 310*a*, an intermediate conveying portion 310*b*, and a downstream-side conveying portion 310*c* and they are arranged in this order along the sheet conveying path 31 from the upstream side in the sheet conveying direction. The upstream-side conveying portion 310*a* includes a first conveying roller pair 313 and a second conveying roller pair 314 provided in order along the sheet conveying path 31. The first conveying roller pair 313 and the second conveying roller pair 314 are rotated/driven by a first stepping motor 365 (see FIG. 11). The intermediate conveying portion 310*b* includes the third conveying roller pair 315 and a fourth conveying roller pair 316 provided in order along the sheet conveying path on the downstream side of the upstream-side conveying portion 310*a*. The third conveying roller pair 315 and the fourth conveying roller pair 316 are rotated/driven by a second stepping motor 366 (see FIG. 11). The downstream-side conveying portion 310*c* includes a fifth conveying roller pair 317 and a sixth conveying roller pair 318 provided in order along the sheet conveying path 31 on the downstream side of the intermediate conveying portion 310*b*. The fifth conveying roller pair 317 and the sixth conveying roller pair 318 are rotated/driven by a third stepping motor 367 (see FIG. 11).

Here, the fifth conveying roller pair 317 corresponds to the "downstream-side conveying roller pair" according to one aspect of the present invention, and the first to fourth conveying roller pairs 313 to 316 arranged on the upstream side of the downstream-side conveying portion correspond to the "upstream-side conveying roller pairs" according to one aspect of the present invention.

In the plurality of conveying roller pairs illustrated in FIG. 4, the second conveying roller pair 314 functions as a curl forcing roller. The fourth conveying roller pair 316 functions as a loop creating roller for forming a loop in the sheet. The fifth conveying roller pair 317 functions as a resist roller.

The inner guide portion 31*a* and the fixed guide portions 31*b* and 31*c* are fixed directly or through an arbitrary member to a rear surface 30A of the sheet conveying device 30. The inner guide portion 31*a* is fixed inside the sheet conveying path 31 curved downward. On the other hand, the fixed guide portions 31*b* and 31*c*, the guide portion 343 of the first movable guide portion body 341, and the guide portion 353 of the second movable guide portion body 351 constitute an outer guide portion of the sheet conveying path 31.

The fixed guide portions 31*b* and 31*c*, the guide portion 343 of the first movable guide portion body 341, and the guide portion 353 of the second movable guide portion body 351 are curved along the curved shape of the inner guide portion 31*a*.

The first movable guide portion body 341 is curved along the curved shape of the inner guide portion 31*a*, has a rotating shaft portion 342 provided on an end portion on the downstream side in the sheet conveying direction, and is pivotally supported by the rotating shaft portion 342 rotatably. The first movable guide portion body 341 is rotated/driven by a guide portion driving mechanism, not shown, so as to open the sheet conveying path 31 on the upstream side of the rotating shaft portion 342. The rotating shaft portion 342 has its axial direction orthogonal to the sheet conveying direction. One end portions of the various rollers and the rotating shaft portion 342 are mounted on the fixed plate 37 arranged on the rear surface 30A side inside the sheet conveying device 30. The other end portions of the various rollers and the rotating shaft portion 342 are mounted on the fixed plate 37 (see FIG. 6) arranged on the front surface side inside the sheet conveying device 30.

At a predetermined position of the first movable guide portion body 341, a locking member 344 is pivotally supported by the rotating shaft portion 345 rotatably. The locking member 344 has one end portion penetrated through the rotating shaft portion 345, and a hook-shaped hook portion 344*a* is formed on the other end portion. The locking member 344 and the hook portion 344*a* constitute the lock mechanism of the first movable guide portion 34.

By hooking the hook portion 344*a* of the locking member 344 by a fixing pin 371 illustrated in FIG. 6, the first movable guide portion body 341 is locked, whereby the first movable guide portion body 341 is held at a position capable of guiding (guiding position) the sheet (lock state).

On the other hand, if the hook portion 344*a* of the locking member 344 is not hooked by the fixing pin 371, the upstream side of the first movable guide portion body 341 rotates clockwise around the rotating shaft portion 342 by its own basis weight (open position), and the sheet conveying path 31 is opened (unlock state) (see FIG. 5).

Moreover, on the first movable guide portion body 341, a driven roller 317*b* of the fifth conveying roller pair 317 constituting the downstream-side conveying portion 310*c* is mounted. As a result, the driven roller 317*b* is moved with rotation of the first movable guide portion body 341. As described above, when the first movable guide portion body 341 is opened, the driven roller 317*b* of the fifth conveying roller pair 317 is retreated integrally with the rotation operation of the first movable guide portion body 341, and pressure contact of the fifth conveying roller pair 317 is released. As a result, a downstream region on the downstream side of the fourth conveying roller pair 316 is opened in the sheet conveying path 31.

The second movable guide portion 35 has a shape substantially symmetrical with the first movable guide portion 34 against the intermediate point of the sheet conveying path 31 and is constituted by substantially the same elements as those of the first movable guide portion 34. The second movable guide portion body 351 of the second movable guide portion 35 has a rotating shaft portion 352 provided on an end portion on the upstream side in the sheet conveying direction and is pivotally supported by the rotating shaft portion 352 rotatably. The second movable guide portion body 351 is rotated/driven by the guide portion driving mechanism, not shown, so as to open the downstream side downward. The rotating shaft portion 352 has its axial direction orthogonal to the sheet conveying direction. One end portion of the rotating shaft portion 352 is mounted on the fixed plate 37 arranged on the rear surface 30A side inside the sheet conveying device 30. The other end portion of the rotating shaft portion 352 is mounted on the fixed plate 37 (see FIG. 8) arranged on the front surface side of the sheet conveying device 30.

At a predetermined position of the second movable guide portion body 351, a locking member 354 is pivotally supported by the rotating shaft portion 355 rotatably. The locking member 354 has one end portion penetrated through the rotating shaft portion 355, and a hook-shaped hook portion 354*a* is formed on the other end portion. The locking member 354 and the hook portion 354*a* constitute the lock mechanism of the second movable guide portion 35.

By hooking the hook portion 354*a* of the locking member 354 by a fixing pin 372 illustrated in FIG. 6, the second movable guide portion body 351 is locked, whereby the second movable guide portion body 351 is held at a position capable of guiding (guiding position) the sheet (lock state).

There, when the first movable guide portion body 341 and the second movable guide portion body 351 are locked, a distal end portion 341*t* of the first movable guide portion body 341 and a distal end portion 351*t* of the second movable guide portion body 351 are brought close to and faced with each other.

On the other hand, if the hook portion 354*a* of the locking member 354 is not hooked by the fixing pin 372, the downstream side of the second movable guide portion body 351 rotates counterclockwise around the rotating shaft portion 352 by its own basis weight (open position), and the sheet conveying path 31 is opened (unlock state) (see FIG. 5).

On the second movable guide portion body 351, a driven roller 316*b* of the fourth conveying roller pair 316 is mounted, and the driven roller 316*b* is moved with rotation of the second movable guide portion body 351. As described above, when the second movable guide portion body 351 is opened, the driven roller 316*b* of the fourth conveying roller pair 316 is retreated integrally with the rotation operation of the second movable guide portion body 351, and pressure contact of the fourth conveying roller pair 316 is released. As a result, an upstream region continuing to the downstream region opened by the first movable guide portion 34 is opened in the sheet conveying path 31.

An operation portion 346 pivotally supported by the rotating shaft portion 345 of the first movable guide portion body 341 and an operation portion 356 pivotally supported by the rotating shaft portion 355 of the second movable guide portion body 351 are used for returning the first movable guide portion body 341 and the second movable guide portion body 351 to the lock positions, respectively. If the user returns the first movable guide portion body 341 and the second movable guide portion body 351 to the lock positions, respectively, and operates the operation portion 346 and the operation portion 356, for example, the lock members 344 and 354 are locked by the fixing pins 371 and 372, respectively, and enter into the lock state. The driven roller 317*b* of the fifth conveying roller pair 317 is arranged at a position closer to the rotating shaft portion 342 on the downstream side of the operation portion 346.

As described above, the automatic path opening mechanism 32 according to the embodiment has the first movable guide portion 34 and the second movable guide portion 35 for opening the sheet conveying path 31. The first movable guide portion 34 and the second movable guide portion 35 include the first and second movable guide portion bodies 341 and 351 rotating around the respective rotating shaft portions 342 and 352 and provided with guide portions 343 and 353 for guiding the sheets and the lock mechanisms for holding the first and second movable guide portion bodies 341 and 351 at positions where guiding of the sheets becomes possible. The lock mechanism is unlocked by an unlock mechanism 38 (see FIG. 6) which will be described later.

At occurrence of jamming, the first movable guide portion body 341 is opened, and the driven roller 317*b* of the fifth conveying roller pair 317 is moved in a direction away from the sheet conveying path 31 integrally with the opening operation, whereby pressure contact of the fifth conveying roller pair 317 is released. At the same time, the second movable guide portion body 351 is opened, and the driven roller 316*b* of the fourth conveying roller pair 316 is moved in a direction away from the sheet conveying path 31 integrally with the opening operation, whereby pressure contact of the fourth conveying roller pair 316 is released. By configuring as above, a region including the region between the fourth conveying roller pair 316 and the fifth conveying roller pair 317 is opened in the sheet conveying path 31, and the sheet in the sheet conveying path 31 is accommodated in the accommodating portion 33. Then, the user can collect the sheets accommodated in the accommodating portion 33 and remove them.

The second conveying roller pair 314 (an example of curl correcting portion) which is a curl correcting roller is provided on the upstream side of the third conveying roller pair 315 arranged in the sheet conveying path 31. Moreover, a curl detecting portion (not shown) for detecting a direction of a curl and a degree of the curl of the sheet is installed on the upstream side of the second conveying roller pair 314. The second conveying roller pair 314 which is the curl correcting roller corrects the curl of the sheet using the roller pair with different hardness, for example, on the basis of a detection result by the curl detecting portion. In the embodiment, the example in which the second conveying roller pair 314 is used as the curl correcting portion is described, but the curl forcing portion may be constituted by using a roller and a belt as another example.

<1-2. Unlock Operation of Automatic Path Opening Mechanism>

Figure 7:
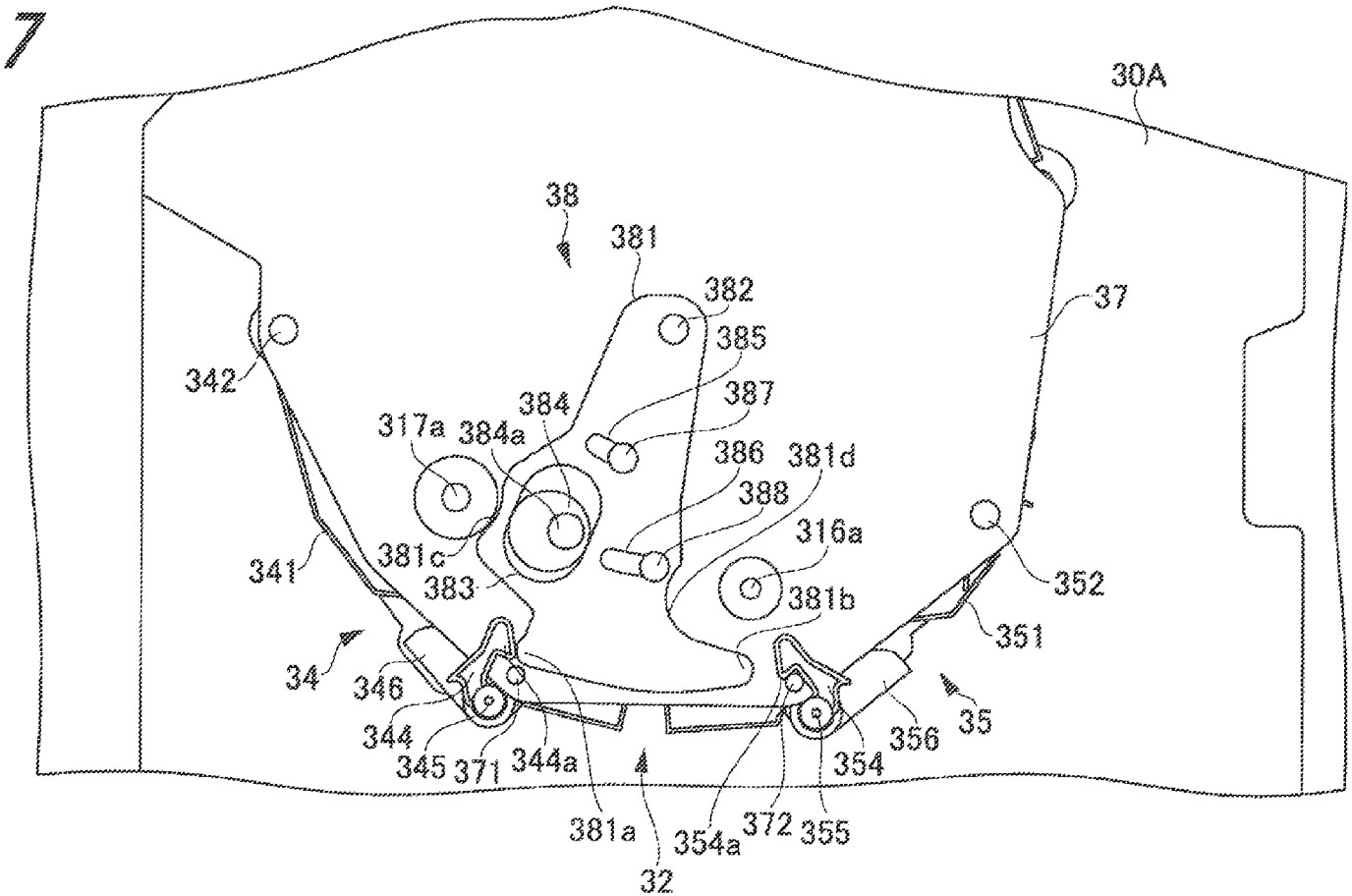
FIG. 7 is a first explanatory view of an unlock operation of an automatic path opening mechanism.
Figure 8:
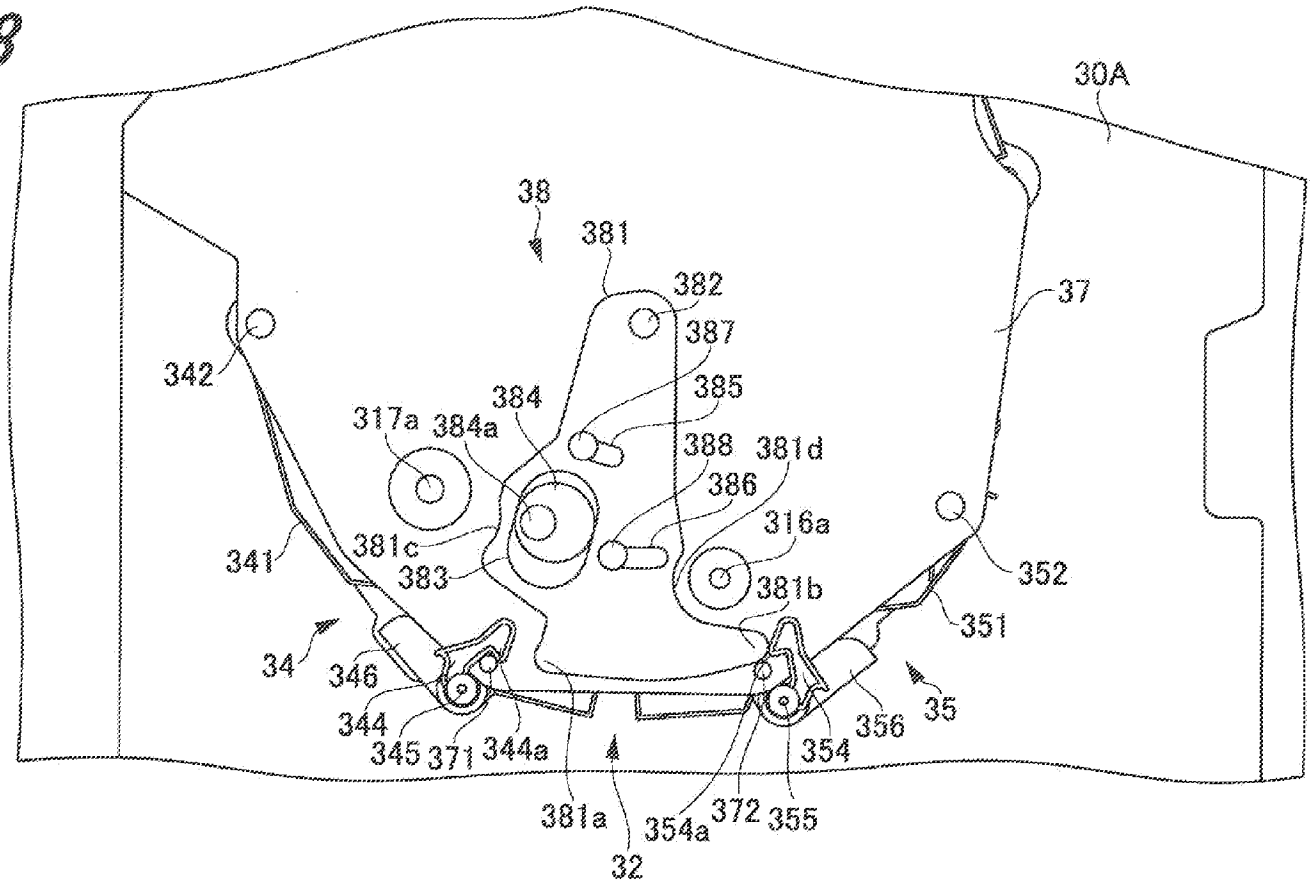
FIG. 8 is a second explanatory view of the unlock operation of the automatic path opening mechanism.

Subsequently, the unlock operation of the automatic path opening mechanism 32 will be described by using FIGS. 6 to 8. FIG. 7 is a first explanatory view of the unlock operation of the automatic path opening mechanism 32. FIG. 8 is a second explanatory view of the unlock operation of the automatic path opening mechanism 32.

The fixing pins 371 and 372 are installed upright on the surface on the front surface side of the fixing plate 37 arranged on the front surface side of the sheet conveying device 30. As illustrated in FIG. 6, when the automatic path opening mechanism 32 is not opened, that is, when the first movable guide portion 34 is in the lock state, the hook portion 344*a* of the locking member 344 provided in the first movable guide portion 34 is locked by the fixing pin 371. Similarly, the hook portion 354*a* of the locking member 354 provided in the second movable guide portion 35 is locked by the fixing pin 372.

The unlock mechanism 38 includes a swing cam 381 and an eccentric cam 384. The swing cam 381 has substantially a fan shape and is pivotally supported by a rotating shaft 382 at a position corresponding to a pivot of the fan and is displaced around the rotating shaft 382. The swing cam 381 has a guide hole 383 for guiding the eccentric cam 384 and guide holes 385 and 386 for guiding guide pins 387 and 388 formed at predetermined positions. The guide pins 387 and 388 are installed upright on the surface of the front surface side of the fixed plate 37. They are arranged in the order of the guide pin 387 and the guide pin 388 from the side closer to the rotating shaft 382.

The eccentric cam 384 is rotated/driven around a rotating shaft 384*a* by an eccentric cam driving portion, not shown, under the control of a swing cam driving control portion 471. A combination of a motor and various mechanisms or various actuators can be employed as the eccentric cam driving portion. When the eccentric cam 384 is rotated, the distance from the rotating shaft 384*a* to an edge of the guide hole 383 is changed and the cam is brought into contact with the edge of the guide hole 383. As a result, the swing cam 381 swings to right and left around the rotating shaft 382. A position of the swing cam 381 illustrated in FIG. 6 is a home position (see FIG. 4) where neither of the first movable guide portion 34 nor the second movable guide portion 35 is unlocked.

On a portion faced with a driving roller 317*a* of the fifth conveying roller pair 317 which is a resist roller on an outer periphery portion of the swing cam 381, an escape portion 381*c* having a recessed shape conforming to the curved surface of the driving roller 317*a* is formed. On a portion faced with a driving roller 316*a* of the fourth conveying roller pair 316 on the outer periphery portion of the swing cam 381, an escape portion 381*d* having a recessed shape conforming to the curved surface of the driving roller 316*a* is formed. By means of these escape portions 381*c* and 381*d*, the outer periphery portion of the swing cam 381 does not touch each of the driving rollers even if the swing cam 381 swings to right and left. The size of the swing cam 381 can be reduced by forming it with such shape.

As illustrated in FIG. 7, when the eccentric cam 384 rotates and a diameter on the left side of the rotating shaft 384*a* becomes long, the swing cam 381 is displaced to the left direction. As a result, a projection portion 381*a* of the swing cam 381 pushes out the hook portion 344*a* of the locking member 344 provided in the first movable guide portion 34. When the hook portion 344*a* of the locking member 344 is pushed out, the lock state of the first movable guide portion 34 is unlocked, and the first movable guide portion body 341 is opened by its own basis weight (see FIG. 5).

As illustrated in FIG. 8, when the eccentric cam 384 further rotates from the state illustrated in FIG. 7 and a diameter on the right side of the rotating shaft 384*a* of the eccentric cam 384 becomes long, the swing cam 381 is displaced to the right direction. As a result, the projection portion 381*a* of the swing cam 381 pushes out the hook portion 354*a* of the locking member 354 provided in the second movable guide portion 35. When the hook portion 354*a* of the locking member 354 is pushed out, the lock state of the second movable guide portion 35 is unlocked, and the second movable guide portion body 351 is opened by its own basis weight (see FIG. 5).

After the hook portion 354*a* of the locking member 354 provided in the second movable guide portion 35 is pushed out by displacement of the swing cam 381 to the right direction, the eccentric cam 384 is rotated to the home position (see FIG. 6) and stopped by a phase actuator on an eccentric cam driving shaft, not shown.

The unlock operation of the automatic path opening mechanism 32 using the swing cam 381 arranged on the front surface side of the sheet conveying device 30 has been described by referring to FIGS. 6 to 8, but the automatic path opening mechanism 32 including the swing cam 381 is arranged also on the rear surface 30A side in the sheet conveying device 30. However, it is only necessary that the automatic path opening mechanism 32 including the swing cam 381 is arranged at least either on the rear surface 30A side or the front surface side.

<1-3. Internal Configuration of Image Forming System>

Subsequently, an internal configuration of the image forming system 1 will be described.

[Internal Configuration of First Image Forming Apparatus]

Figure 9:
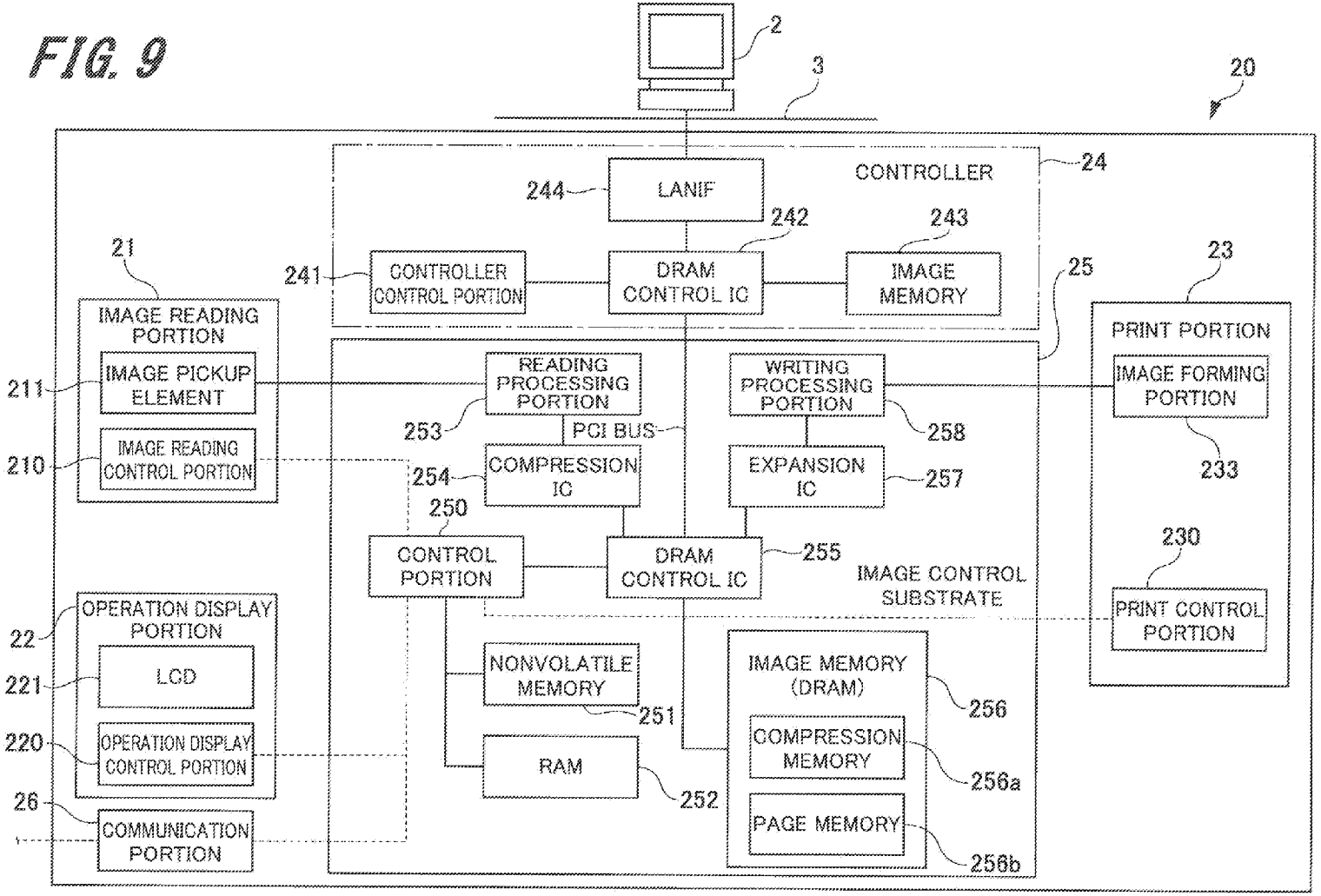
FIG. 9 is a block diagram illustrating an internal configuration of a first image forming apparatus of the image forming system.

FIG. 9 is a block diagram illustrating the internal configuration of the first image forming apparatus 20 of the image forming system 1. As illustrated in FIG. 9, the first image forming apparatus 20 includes an image reading portion 21, an operation display portion 22, a print portion 23, a controller 24, an image control substrate 25, a communication portion 26 and the like. The first image forming apparatus 20 is connected to an external device 2 on the network 3 via a LANIF (Local Area Network InterFace) 244 of the controller 24 capable of mutual transmission/reception of data.

The image reading portion 21 includes the above-described automatic document feeding portion and reading portion and an image reading control portion 210. The image reading control portion 210 realizes a scanner function for reading images of a plurality of documents by controlling the automatic document feeding portion, the reading portion and the like on the basis of an instruction from the control portion 250. Analog image data read out by the image reading portion 21 is output to a reading processing portion 253 and A/D converted in the reading processing portion 253 and is subjected to various types of image processing.

The operation display portion 22 includes the above-described LCD 221, a touch panel and the like and an operation display control portion 220. The operation display control portion 220 displays various screens for inputting various setting conditions and an operation screen for displaying various processing results and the like on the LCD in accordance with a display signal input from the control portion 250. The operation display control portion 220 outputs an operation signal input from the various switches, buttons, ten keys, operation key groups or the touch panel and the like to the control portion 250.

The print portion 23 includes each portions relating to print output such as the above-described paper feeding portion 231, the sheet conveying portion 232, the image forming portion 233, the fixation portion 234 (see FIG. 1) and the like and a print control portion 230. The print control portion 230 controls operation of each portion of the print portion 23 such as the image forming portion 233 in accordance with the instruction from the control portion 250 and has image formation performed on the basis of print image data input from the writing processing portion 258.

The controller 24 is to manage and control data input into the image forming system 1 from the external device 2 connected to the network 3. The controller 24 receives data to be printed (print data and print setting data) from the external device 2 and transmits the image data generated by extending the print data and the print setting data to the image control substrate 25. The controller 24 is constituted by a controller control portion 241, a DRAM (Dynamic Random Access Memory) control IC 242, an image memory 243, the LANIF 244 and the like.

The controller control portion 241 integrally controls operation of each portion of the controller 24, extends the print data input from the external device 2 through the LANIF 244 and generates image data in the bitmap format.

The DRAM control IC 242 controls transfer of the print data received through the LANIF 244 to the controller control portion 241 and writing/reading of the image data and the print setting data with respect to the image memory 243. The DRAM control IC 242 is connected to the DRAM control IC 255 of the image control substrate 25 through a PCI (Peripheral Components Interconnect) bus. The DRAM control IC 242 reads out the image data to be printed and the print setting data from the image memory 243 and outputs them to the DRAM control IC 255 in accordance with the instruction from the controller control portion 241.

The image memory 243 is constituted by volatile memory such as DRAM and temporarily stores the image data and the print setting data.

The LANIF 244 is a communication interface to be connected to the network 3 such as LAN and the like including NIC (Network Interface Card) and a modem and receives the print data and the print setting data from the external device 2. The received print data and print setting data are output to the DRAM control IC 242.

The image control substrate 25 includes the control portion 250, the nonvolatile memory 251, a RAM (Random Access Memory) 252, the reading processing portion 253, a compression IC 254, the DRAM control IC 255, an image memory 256, an expansion IC 257, the writing processing portion 258 and the like.

The control portion 250 is constituted by a CPU (Central Processing Unit) and the like and reads out a designated program form a system program stored in the nonvolatile memory 251 and various application programs and extends them in the RAM 252. Then, the control portion 250 executes various types of processing in collaboration with the programs extended in the RAM 252 and integrally controls each portion of the first image forming apparatus 20.

Since the first image forming apparatus 20 is set to be a main machine, the control portion 250 receives a signal indicating a state of each device from each device constituting the image forming system 1 through the communication portion 26. Then, the control portion 250 integrally controls the entire image forming system 1 on the basis of the signal indicating the state of each device. If a signal indicating an error (JAM occurrence, running out of sheets, toner shortage or the like) in the second image forming apparatus 40 is received, for example, a display signal or an operation instruction signal according to the error is generated, and the generated signal is transmitted to the operation display portion 22 or the second image forming apparatus or the like.

Moreover, the control portion 250 generates job data and compressed image data on the basis of the image data and the print setting data input from the external device 2 through the controller 24 or the image data input from the image reading portion 21 and the setting information set by the operation display portion 22. Then, the control portion 250 executes a job in collaboration with the second image forming apparatus 40 on the basis of the generated job data and compressed image data.

The job is a series of operations relating to image formation and if a copy composed of a document on a predetermined page is to be created, for example, a series of operations relating to the image formation of the document on the predetermined page is one job. Data for performing the operation of the job is the job data.

The job data includes job information and page information. The job information is information in common to all the pages. The job information includes set number of copies of the job, the sheet ejection tray, applied functions (aggregation, repeat and the like), color/monochrome and the like, for example. The page information is related to the compressed image data of each page and information relating to the associated compressed image data. The page information includes a page number, an image size (horizontal and vertical), an image direction, an image width, a rotation angle of an image, a type of sheet on which an image is formed, a paper feeding tray in which the sheets are stored, a print mode (double-side mode/single-side mode), a storing address of the compressed image data and the like, for example.

The nonvolatile memory 251 stores various processing programs and various data and the like relating to image formation. Moreover, the nonvolatile memory 251 stores information on the type of sheets stored in each of the paper feeding trays provided in the paper feeding device 10, the paper feeding portion of the first image forming apparatus 20, and the paper feeding portion of the second image forming apparatus 40, respectively.

The RAM 252 forms a work area for temporarily storing the various programs executed by the control portion 250 and the various data and the like relating to these programs. Moreover, the RAM 252 temporarily stores the job data generated by the control portion 250 on the basis of the image data and the print setting data input from the controller 24 or the image data input from the image reading portion 21 and the setting information set by the operation display portion 22 when the image data is acquired.

The reading processing portion 253 applies various types of processing such as analog processing, A/D conversion processing, shading processing and the like to the analog image data input from the image reading portion 21 and then, generates digital image data. The generated image data is output to the compression IC 254.

The compression IC 254 applies compression processing to the input digital image data and outputs it to the DRAM control IC 255.

The DRAM control IC 255 controls compression processing of the image data by the compression IC 254 and expansion processing of the compressed image data by the expansion IC 257 in accordance with the instruction from the control portion 250 and executes input/output control of the image data into/from the image memory 256.

When a storage instruction of the image data read out by the image reading portion 21 is input from the control portion 250, for example, the DRAM control IC 255 makes the compression IC 254 execute compression processing of the image data input into the reading processing portion 253 and has the compressed image data stored in the compression memory 256*a* of the image memory 256. Moreover, when the image data is input from the DRAM control IC 242 of the controller 24, the DRAM control IC 255 makes the compression IC 254 execute compression processing of the image data and has the compressed image data stored in the compression memory 256*a* of the image memory 256.

Furthermore, when a print output instruction of the compressed image data stored in the compression memory 256*a* is input from the control portion 250, the DRAM control IC 255 reads out the compressed image data from the compression memory 256*a*, applies expansion processing by the expansion IC 257 and has it stored in the page memory 256*b*. Moreover, when a print output instruction of the image data stored in the page memory 256*b* is input, the image data is read out from the page memory 256*b* and is output to the writing processing portion 258.

The image memory 256 includes the compression memory 256*a* constituted by a DRAM (Dynamic RAM) and the page memory 256*b*. The compression memory 256*a* is memory for storing compressed image data, and the page memory 256*b* is memory for temporarily storing the image data for print output or for temporarily storing the image data received from the controller before compression.

The expansion IC 257 applies expansion processing to the compressed image data.

The writing processing portion 258 generates print image data for image formation on the basis of the image data input from the DRAM control IC 255 and outputs it to the print portion 23.

The communication portion 26 is a communication interface for connection to the network to which each of the devices constituting the image forming system 1 is connected. The communication portion 26, for example, conducts communication with the second image forming apparatus 40 by using the NIC (Network Interface Card) or the like and also conducts serial communication with the paper feeding device 10 and the sheet conveying device 30.

[Internal Configuration of Second Image Forming Apparatus]

Figure 10:
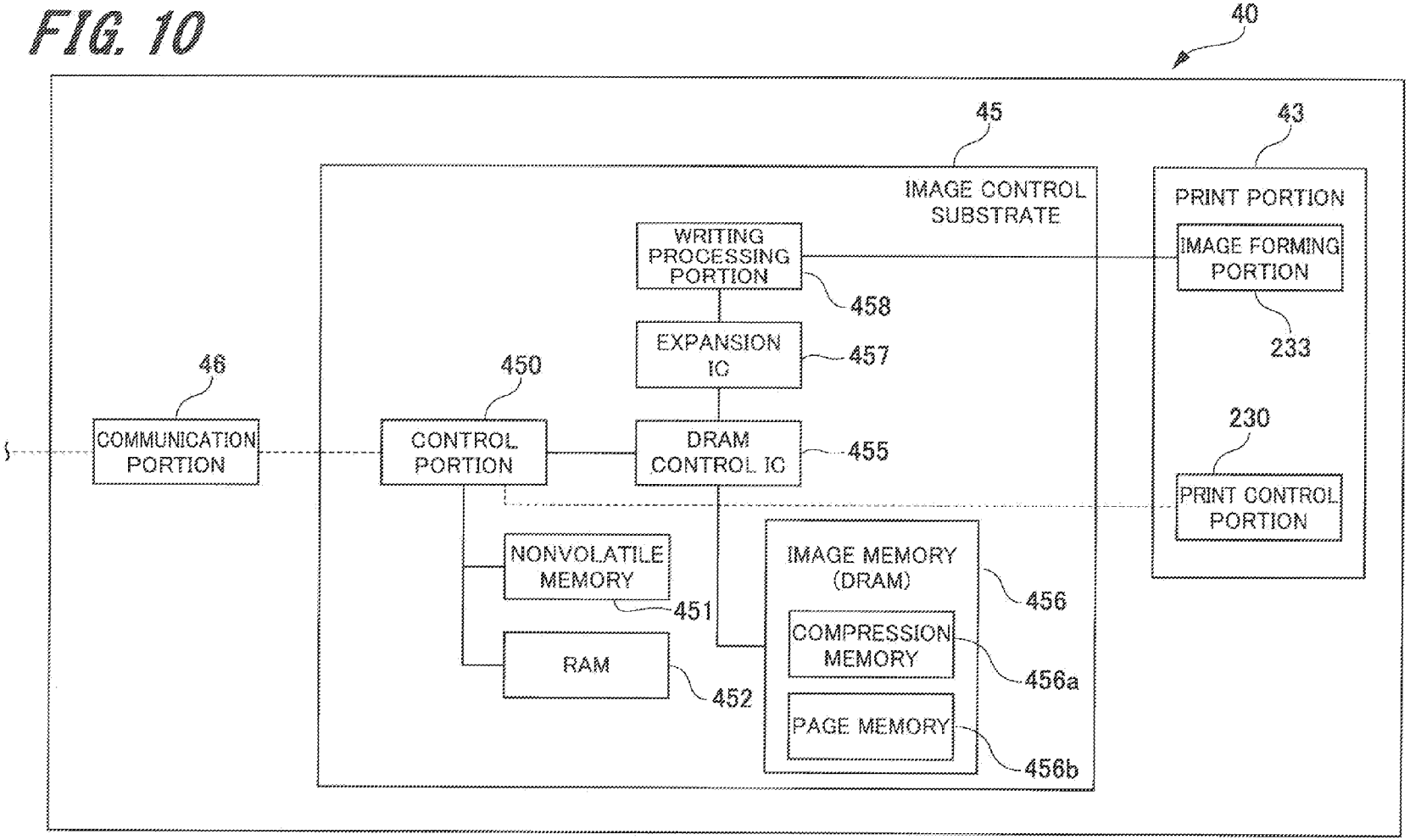
FIG. 10 is a block diagram illustrating an internal configuration of a second image forming apparatus of the image forming system.

FIG. 10 is a block diagram illustrating an internal configuration of the second image forming apparatus 40 of the image forming system 1. As illustrated in FIG. 10, the second image forming apparatus 40 includes the print portion 43, an image control substrate 45, a communication portion 46 and the like.

Since the print portion 43 has the same configuration as that of the print portion 23 of the first image forming apparatus 20, explanation will be omitted.

The image control substrate 45 includes a control portion 450, nonvolatile memory 451, a RAM 452, a DRAM control IC 455, image memory 456, an expansion IC 457, a writing processing portion 458 and the like.

The control portion 450 is constituted by a CPU and the like and reads out a program designated from the system programs and various application programs stored in the nonvolatile memory 451 and extends it to the RAM 452. Then, the control portion 450 executes various types of processing in collaboration with the program extended to the RAM 452 and intensively controls each portion of the second image forming apparatus 40 and the sheet conveying device 30.

The nonvolatile memory 451 stores various processing programs and various data and the like relating to image formation. The nonvolatile memory 451 stores information on the type of sheets stored in each of the paper feeding trays provided in each of the paper feeding device 10, the paper feeding portion of the second image forming apparatus 40, and the paper feeding portion of the first image forming apparatus 20.

The RAM 452 forms a work area for temporarily storing the various programs executed by the control portion 450 and the various data and the like relating to the programs. Moreover, the RAM 452 temporarily stores data input from the first image forming apparatus 20 through the communication portion 46.

The DRAM control IC 455 controls expansion processing of the compressed image data by the expansion IC 457 and executes input/output control of the image data into/from the image memory 456 in accordance with the instruction from the control portion 450.

When the job data and the compressed image data are input from the communication portion 46, for example, the DRAM control IC 455 has the job data stored in the RAM 452 and the compressed image data in the compression memory 456*a* of the image memory 456, respectively. Moreover, when the print output instruction of the compressed image data stored in the compression memory 456*a* is input from the control portion 450, the DRAM control IC 455 reads out the compressed image data from the compression memory 456*a* and subjects it to the expansion processing by the expansion IC 457 and has it stored in the page memory 456*b*. Moreover, when the print output instruction of the image data stored in the page memory 456*b* is input, the image data is read out of the page memory 456*b* and is output to the writing processing portion 458.

The image memory 456 includes the compression memory 456*a* and the page memory 456*b* constituted by DRAM. The compression memory 456*a* is memory for storing the compressed image data, and the page memory 456*b* is memory for temporarily storing the image data for print output.

The expansion IC 457 applies the expansion processing to the compressed image data.

The writing processing portion 458 generates print image data for image formation on the basis of the image data input from the DRAM control IC 455 and outputs it to the print portion 43.

The communication portion 46 is a communication interface for connection to the network to which each of the devices constituting the image forming system 1 is connected. The communication portion 46 conducts communication with the first image forming apparatus 20 by using NIC or the like or conducts serial communication with the sheet conveying device 30 and the post-processing device 50, for example.

[Internal Configuration of Sheet Conveying Device]

Figure 11:
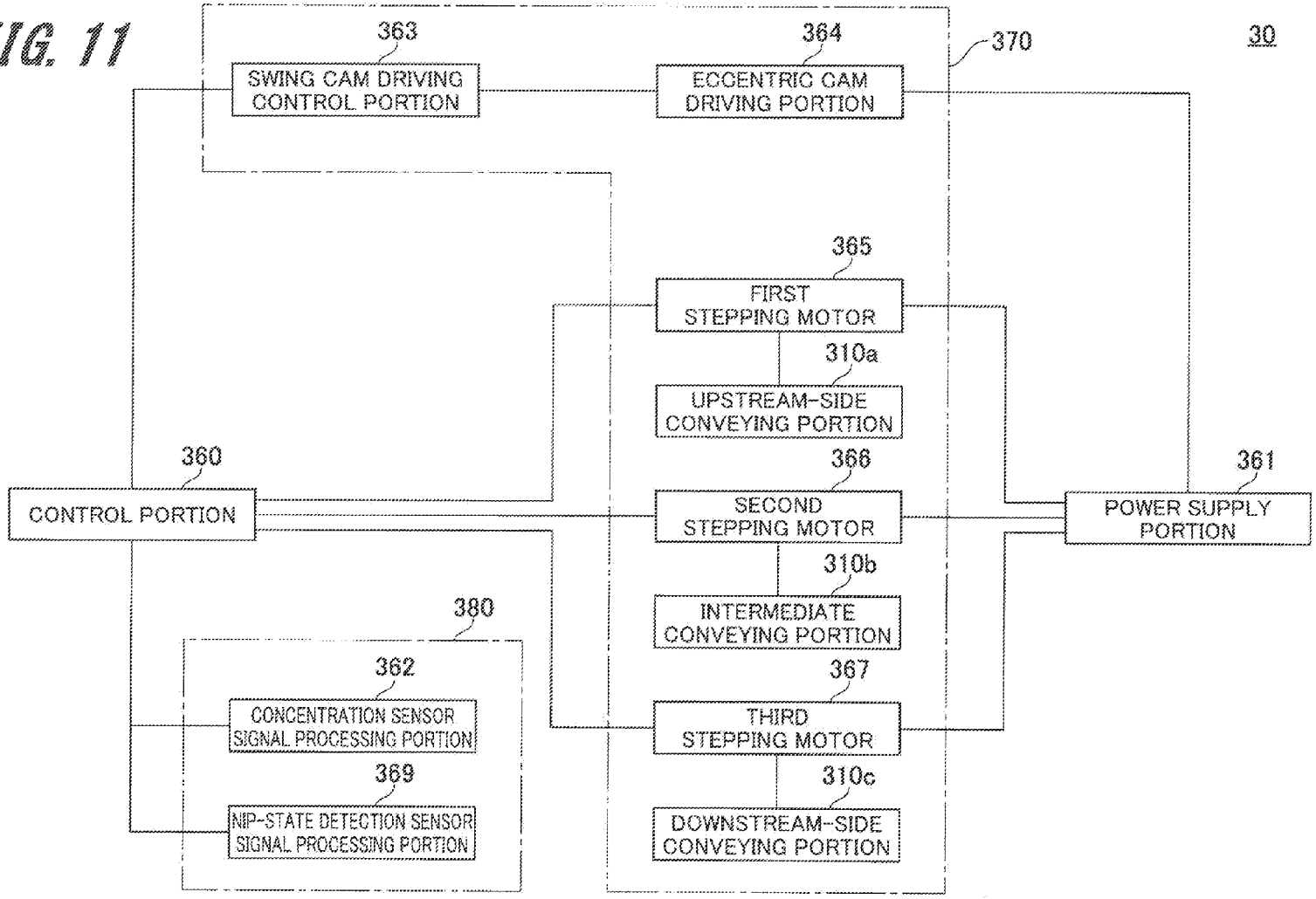
FIG. 11 is a block diagram illustrating an internal configuration of the sheet conveying device of the image forming system.

FIG. 11 is a block diagram illustrating an internal configuration of the sheet conveying device 30 of the image forming system 1. As illustrated in FIG. 11, the sheet conveying device 30 includes a control portion 360, a signal processing portion 380, a driving portion 370, and a power supply portion 361.

The control portion 360 is constituted by a CPU and the like and controls each portion of the driving portion 370 on the basis of a signal sent from the signal processing portion 380 and control signals of the first image forming apparatus 20 and the second image forming apparatus 40 received through a communication portion, not shown.

The signal processing portion 380 has a concentration sensor signal processing portion 362 and a nip-state detection sensor signal processing portion 369. The concentration sensor signal processing portion 362 applies predetermined signal processing to a sensor signal output from the concentration sensor 319 under the control of the control portion 360 and sends a processed signal to the control portion 450 of the second image forming apparatus 40 through the communication portion 46 (see FIG. 10). In the second image forming apparatus 40, the control portion 450 receives a signal sent from the concentration sensor signal processing portion 362 and adjusts concentration of the image to be formed in the second image forming apparatus 40 on the basis of a measurement result of the concentration sensor 319. A gamma curve of a test pattern image is corrected as an example.

The nip-state detection sensor signal processing portion 369 applies predetermined signal processing to a sensor signal output from the nip-state detection sensor (not shown) under the control of the control portion 360 and sends the processed signal to the control portion 360. The control portion 360 controls each portion of the driving portion 370 on the basis of the signal received from the nip-state detection sensor signal processing portion 369.

The driving portion 370 includes a swing cam driving control portion 363, an eccentric cam driving portion 364, the first stepping motor 365, the second stepping motor 366, and the third stepping motor 367.

The swing cam driving control portion 363 generates a control signal for controlling driving of the eccentric cam 384 for making the swing cam 381 (FIG. 6) swing under the control of the control portion 360 and sends the control signal to the eccentric cam driving portion 364.

The first stepping motor 365 rotates/drives the first conveying roller pair 313 and the second conveying roller pair 314 constituting the upstream-side conveying portion 310*a* under the control of the control portion 360. Moreover, the second stepping motor 366 rotates/drives the third conveying roller pair 315 and the fourth conveying roller pair 316 constituting the intermediate conveying portion 310*b* under the control of the control portion 360. Furthermore, the third stepping motor 367 rotates/drives the fifth conveying roller pair 317 and the sixth conveying roller pair 318 constituting the downstream-side conveying portion 310*c* under the control of the control portion 360.

The power supply portion 361 supplies power (electric current) required for each of the eccentric cam driving portion 364, the first stepping motor 365, the second stepping motor 366, and the third stepping motor 367. Here, the power (electric current) required for each of the eccentric cam driving portion 364, the first stepping motor 365, the second stepping motor 366, and the third stepping motor 367 and driving timing are controlled by the control portion 360.

Though not shown, a communication portion is provided also in the sheet conveying device 30, and serial communication is conducted with the first image forming apparatus 20, the second image forming apparatus 40, and the post-processing device 50.

<1-3. Operation at Occurrence of Jamming>

Figure 12:
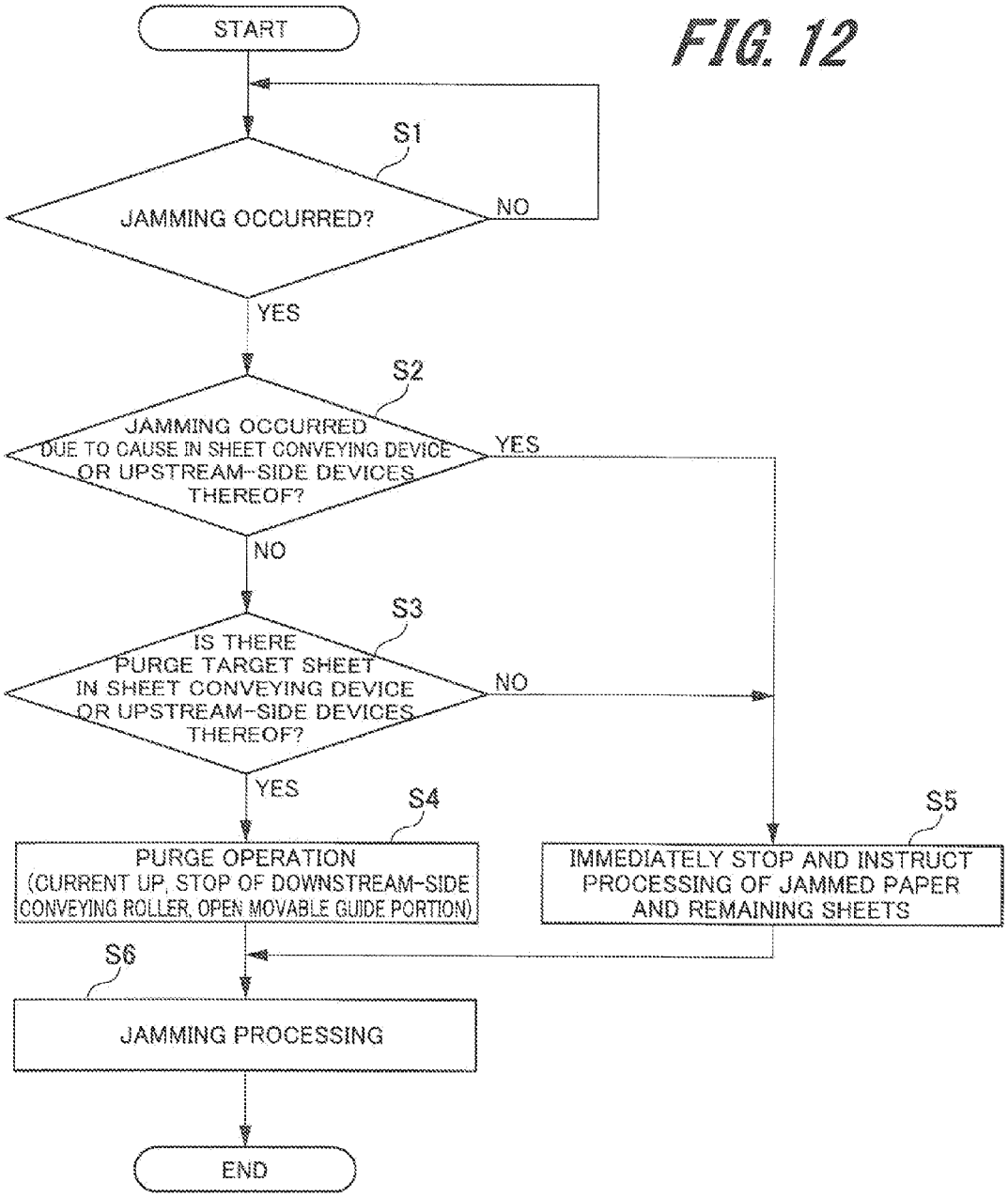
FIG. 12 is a flowchart illustrating a purge operation and a jamming processing of the sheet conveying device at occurrence of jamming.

Subsequently, an operation of the sheet conveying device 30 when jamming occurs in the image forming system 1 will be described. FIG. 12 is a flowchart illustrating a purge operation and jamming processing of the sheet conveying device 30 at occurrence of jamming. First, the control portion 360 of the sheet conveying device 30 determines whether jamming has occurred in the image forming system 1 by presence/absence of a jamming signal, and if jamming has not occurred, the determination processing is continued (Step S1).

If jamming occurs, the control portion 360 determines whether the jamming is caused inside the sheet conveying device 30 or in the devices on the upstream side thereof (the first image forming apparatus 20, for example) on the basis of the received jamming signal (Step S2). If the jamming is caused in the sheet conveying device 30 or in the devices on the upstream side thereof (YES at Step S2), the control portion 360 immediately stops conveying of the sheet. Then, the control portion 360 executes control such that a message of instructing processing of the jammed sheet and remaining sheets to the user is displayed on the LCD 221 of the operation display portion 22 of the first image forming apparatus 20 through the communication portion 26 (Step S5). After that, the user executes jamming processing of removing the jammed sheets and the remaining sheets (Step S6). As a result, processing at occurrence of jamming is finished.

If the jamming is not caused inside the sheet conveying device 30 or in the devices on the upstream side thereof (NO at Step S2), the control portion 360 determines whether or not there is a purge target sheet in the sheet conveying device 30 or in the devices on the upstream side thereof (Step S3). If it is determined that the purge target sheet is not in the sheet conveying device 30 or in the devices on the upstream side thereof (NO at Step S3), the control portion 360 immediately stops conveying of the sheet. Then, the control portion 360 executes control such that a message of instructing processing of the jammed sheet and remaining sheets to the user is displayed on the LCD 221 of the operation display portion 22 of the first image forming apparatus 20 through the communication portion 26 (Step S5). After that, the user executes jamming processing of removing the jammed sheets and the remaining sheets (Step S6). As a result, processing at occurrence of jamming is finished.

On the other hand, if it is determined that the purge target sheet is in the sheet conveying device 30 or in the devices on the upstream side thereof (YES at Step S2), the control portion 360 starts the purge operation (Step S4). In the purge operation at Step S4, in a state in which the first to fourth conveying roller pairs 313 to 316 constituting the upstream-side conveying portion 310*a* and the intermediate conveying portion 310*b* are continuously rotated, the rotation of the fifth and sixth conveying roller pairs 317 and 318 constituting the downstream-side conveying portion 310*c* is stopped. Then, by sequentially moving the first movable guide portion 34 and the second movable guide portion 35 and by opening the sheet conveying path 31, the purge target sheet is ejected. Moreover, during the purge operation, a driving current of the first and second stepping motors 366 and 367 driving the first to fourth conveying roller pairs 313 to 316 is made larger than that during normal sheet conveyance. Details of the purge operation will be described later. After that, the jamming processing for removing the jammed sheet and the remaining sheets is executed by the user (Step S6). As a result, the purge operation and the jamming processing at occurrence of jamming are finished.

[Purge Operation]

Figure 13:
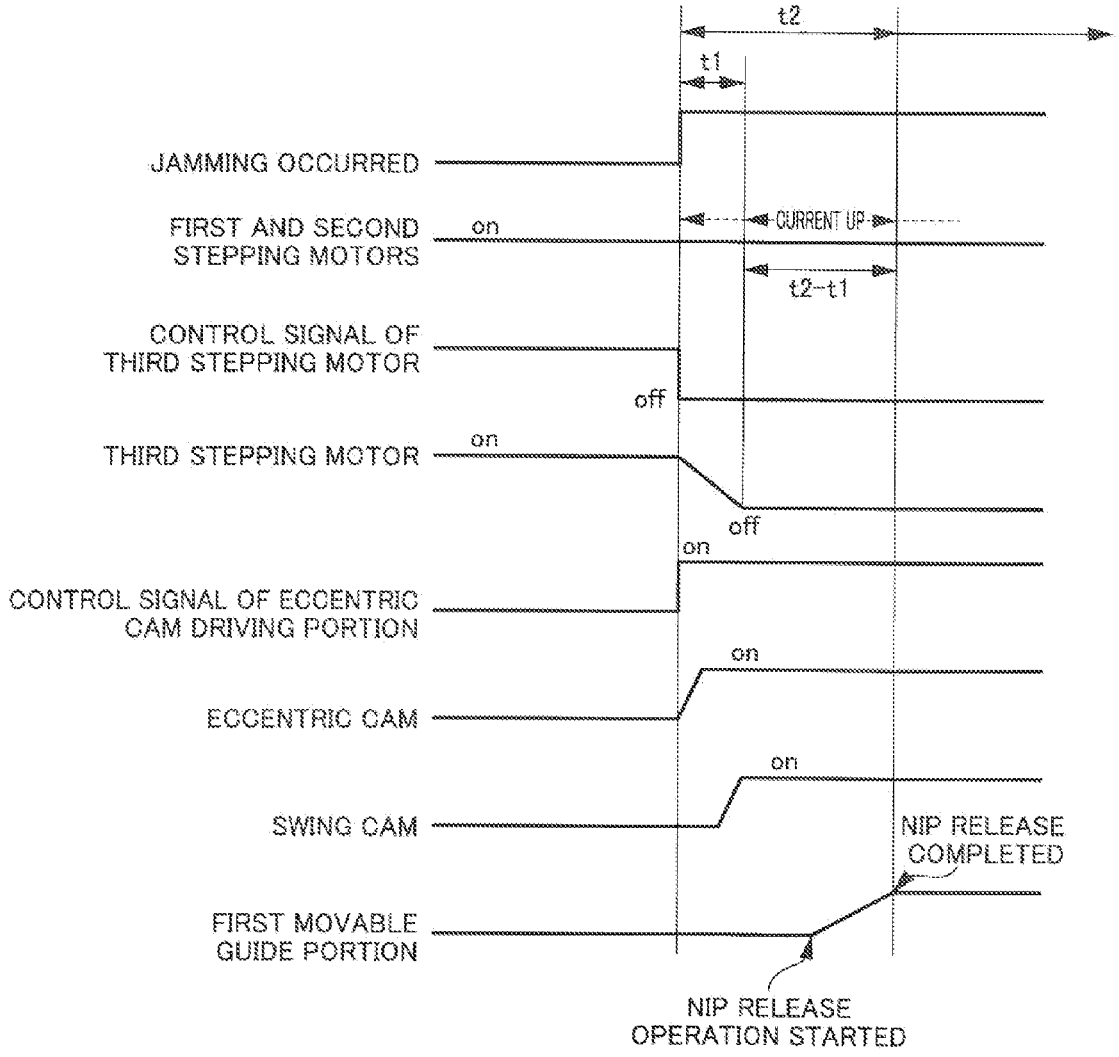
FIG. 13 illustrates a timing chart in the purge operation.

FIG. 13 illustrates a timing chart in the purge operation performed at Step S4 in FIG. 12. First, at the same time as occurrence of jamming, the control portion 360 turns off the control signal controlling the third stepping motor 367 and drives/controls the swing cam driving control portion 363, and the swing cam driving control portion 363 turns on the control signal controlling the eccentric cam driving portion 364. At the time, the first and second stepping motors 366 and 367 are brought into the on state similarly to that before the occurrence of jamming.

As a result, the third stepping motor 367 is turned off (stopped), and rotation of the fifth conveying roller pair 317 and the sixth conveying roller pair 318 of the downstream-side conveying portion 310*c* is stopped and thus, conveyance of the sheet from the downstream-side conveying portion 310*c* to the second image forming apparatus 40 side is stopped. Then, by turning on the driving signal of the eccentric cam driving portion 364, the eccentric cam 384 and the swing cam 381 are operated, the first movable guide portion 34 and the second movable guide portion 35 are sequentially moved, and the sheet conveying path 31 is opened. As described above, in the purge operation, the fifth and sixth conveying roller pairs 317 and 318 are stopped, and the first to fourth conveying roller pairs 313 to 316 are continuously rotated, and moreover, the sheet conveying path 31 in the vicinity of the intermediate conveying portion 310*b* and the downstream-side conveying portion 310*c* is opened by the automatic path opening mechanism 32. As a result, the purge target sheet conveyed from the upstream side can be accommodated in the accommodating portion 33 in a concentrated manner without conveying it to the downstream side of the downstream-side conveying portion 310*c*.

When the control signal controlling the third stepping motor 367 is turned off, it takes time until the rotation of the motor is completely stopped due to motor characteristics. Thus, as illustrated in FIG. 13, the rotation of the third stepping motor 367 is stopped with a delay of time t1 after the control signal is turned off. Similarly, when the control signal controlling the eccentric cam driving portion 364 is turned on, it takes time until the motor and the like constituting the eccentric cam driving portion 364 completely start and operate the eccentric cam 384. Thus, when the control signal of the eccentric cam driving portion 364 is turned on, the eccentric cam 384 starts operation with a slight delay, and moreover, the swing cam 381 starts operation after the eccentric cam 384 starts operation.

The swing cam 381 first unlocks the lock state of the first movable guide portion 34 by swinging to the downstream side. Then, the first movable guide portion 34 starts to rotate in a direction away from the sheet conveying path 31, and a nip releasing operation of the nip portion in the fifth conveying roller pair 317 is started. After that, by releasing pressure contact between the driven roller 317*b* and the driving roller 317*a* constituting the fifth conveying roller pair 317, the nip release in the first movable guide portion 34 is completed. Then, due to the structure of the automatic path opening mechanism 32, it takes time (t2 (>t1)) longer than time (t1) required for stop of the third stepping motor 367 until the nip release in the first movable guide portion 34 is completed from occurrence of the jamming.

On the other hand, for the purge operation, only the fifth and sixth conveying roller pairs 317 and 318 are stopped, and the first to fourth conveying roller pairs 313 to 316 are continuously rotated. Then, a rapid load is applied to the sheet in a direction opposite to the sheet conveying direction due to the stop of the rotation of the fifth and sixth conveying roller pairs 317 and 318. If the length of the purge target sheet in the conveying direction is a length to be nipped by the fourth and fifth conveying roller pairs 316 and 317 at the same time, the rapid load is applied to the first and second stepping motors 365 and 366, and there is a concern that the motors go out of step. The out-of-step can occur during the time in which a load is applied to the first to fourth conveying roller pairs 313 to 316, that is, a period (t2−t1) from when the third stepping motor 367 is stopped (turned off) until the nip release of the first movable guide portion 34 is completed.

Thus, in the embodiment, during the period t2−t1 in which out-of-step of the first and second stepping motors 365 and 366 is concerned about, the out-of-step of the first and second stepping motors 365 and 366 is prevented by raising the driving currents of the first and second stepping motors 365 and 366.

In the embodiment, during normal sheet conveyance, the first and second stepping motors 365 and 366 were driven at 1.5 A, and during the period t2−t1, they were driven at 2.3 A. The driving currents of the first and second stepping motors 365 and 366 are set by the control portion 360 as illustrated in FIG. 11 and can be changed by supplying required currents to the first and second stepping motors 365 and 366 from the power supply portion 361. In the embodiment, when release of the nip of the first movable guide portion 34 is detected is detected by the nip-state detection sensor (not shown), the control portion 360 executes control such that the first and second stepping motors 365 and 366 are driven by the driving currents in the normal sheet conveyance.

By increasing the driving currents to the first and second stepping motors 365 and 366, conveying force (torque) of the first to fourth conveying roller pairs 313 to 316 can be temporarily raised. When the driving currents to the first and second stepping motors 365 and 366 are converted to torque, it is 297 mNm at the driving current of 1.5 A and 464 mNm at 2.5 A. By increasing the conveying force, resistance against the load applied to the first to fourth conveying roller pairs 313 to 316 side from the sheet can be raised during the period (t2−t1) in which the out-of-step of the first and second stepping motors 365 and 366 is concerned about. As a result, the out-of-step of the first and second stepping motors 365 and 366 can be prevented.

In the embodiment, the driving currents of the first and second stepping motors 365 and 366 are set to 1.5 A to 2.3 A as an example, but the magnitude of the driving current required for preventing out-of-step changes depending on rigidity of the sheet being conveyed. Here, the rigidity refers to stiffness of the sheet (difficulty of being bent or buckled). In the embodiment, the driving currents of the first and second stepping motors 365 and 366 are set to a driving current value (2.3 A) by which the out-of-step can be prevented even if the sheet with rigidity of twice is conveyed as compared to the specification of the image forming system 1 in which the sheet with rigidity at 500 can be conveyed.

The embodiment is configured such that the driving currents of the first and second stepping motors 365 and 366 are increased in the period (t2–t1) in FIG. 13, but it may be so configured that the driving currents of the first and second stepping motors 365 and 366 are increased at the same time as occurrence of jamming. Alternatively, it may be so configured that the current values of the driving currents of the first and second stepping motors 365 and 366 are maintained at the same value as the current value in the period (t2–t1) until the series of purge operations are finished, for example, even after the nip release by the first movable guide portion 34 has been completed.

Moreover, the embodiment is configured such that the timing when the nip release in the first movable guide portion 34 is completed in the purge operation is detected by the nip-state detection sensor but it may be so configured that the position of the first movable guide portion 34 is detected by a position detecting portion. The position detecting portion is constituted by a position detection switch provided in the vicinity of the first movable guide portion 34, for example, and the nip state of the first movable guide portion 34 can be detected by detecting contact or separation of the first movable guide portion 34 with or from the position detection switch. Other than that, a rotation detection sensor may be used for the position detecting portion. By detecting a rotation angle of the operation portion 346 or the like by the rotation detection sensor, the nip state of the first movable guide portion 34 can be detected. Moreover, it may be so configured that, after the nip of the first movable guide portion 34 is released from occurrence of jamming, the fifth and sixth conveying roller pairs 317 and 318 are stopped by using a timer.

In order to prevent out-of-step of the stepping motor, the conveying forces of the first and second stepping motors 365 and 366 may be maintained at a value that can bear an expected rapid load. However, in the embodiment, the conveying forces of the first and second stepping motors 365 and 366 are set so as to become the conveying forces that can bear the rapid load caused by rapid stop of sheet conveyance only during the purge operation. As a result, suppression of a temperature rise of the device, an energy saving effect, and improvement of a motor life and durability can be realized.

The embodiment is configured such that the conveying force of the first and second stepping motors 365 and 366 are set large during the purge operation regardless of the paper type (size, basis weight, rigidity). However, in actuality, the above-described out-of-step of the first and second stepping motors 365 and 366 can occur when the length of the purge target sheet in the conveying direction is the length nipped by the fourth and fifth conveying roller pairs 316 and 317 at the same time. Moreover, whether the first and second stepping motors 365 and 366 becomes out of step or not during the purge operation depends on a basis weight and rigidity of the purge target sheet. In the following example, an example in which the purge operation is made different depending on the paper type (size, basis weight, rigidity) of the purge target sheet will be described.

2. Second Embodiment

Image Forming System

Subsequently, an image forming system according to a second embodiment of the present invention will be described. The image forming system of the embodiment is an example different from the first embodiment in the purge operation and the jamming processing at occurrence of jamming. The other configurations are similar to those in the first embodiment, and duplicated explanation will be omitted.

Figure 14:
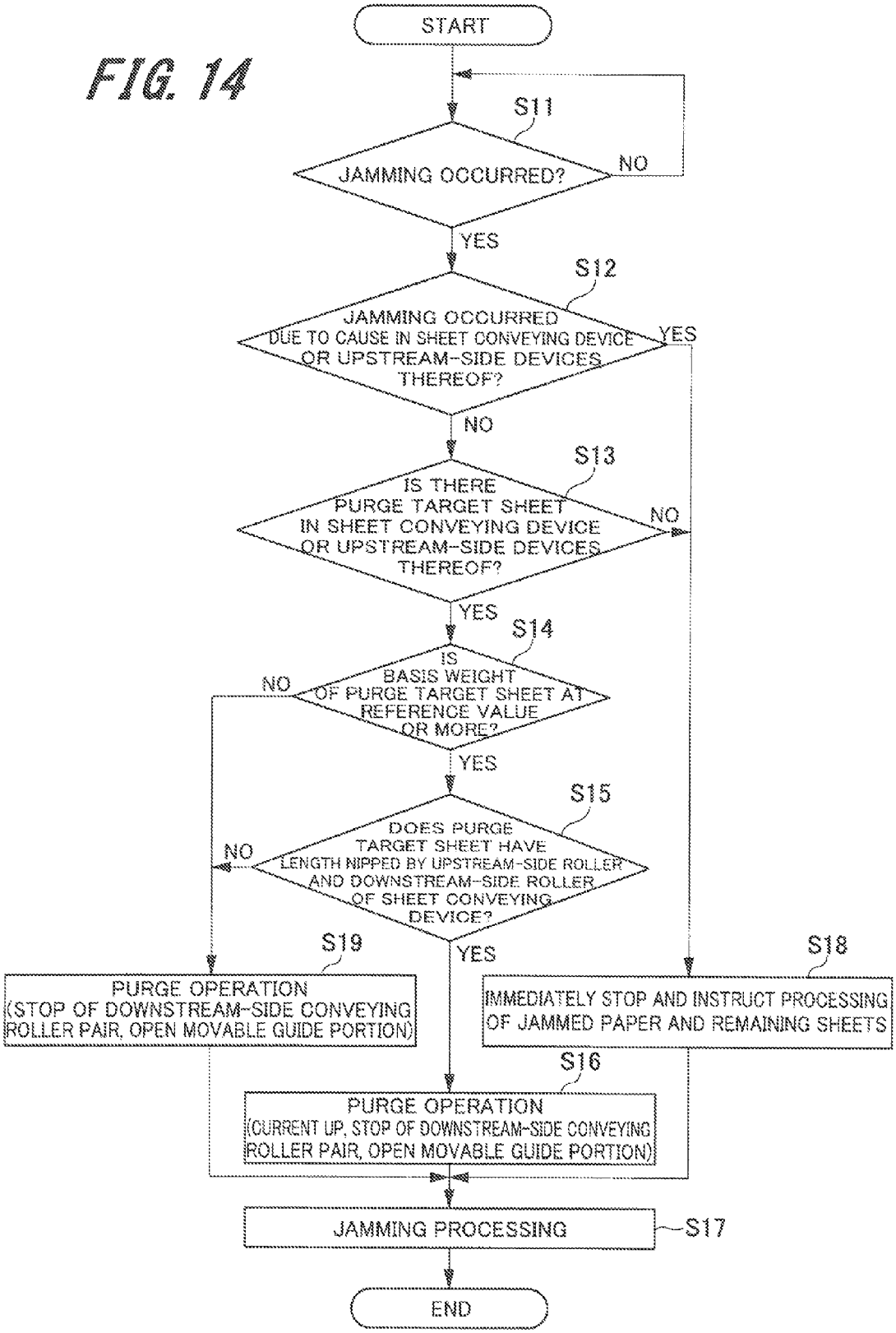
FIG. 14 is a flowchart at occurrence of jamming in a second embodiment of the present invention.

FIG. 14 is a flowchart at occurrence of jamming in the embodiment. Since Steps S11 to S13, S18, and S17 in FIG. 14 are the same as Step S1 to S4, S5 and S6 described in FIG. 12, the explanation will be omitted and the explanation will be made from Step S14.

If it is determined that the purge target sheet is in the sheet conveying device 30 or in the devices on the upstream side thereof (YES at Step S13), then, the control portion 360 determines whether or not a basis weight (g/m2) of the purge target sheet is at a reference value or more (Step S14). Here, the reference value of the basis weight is set in the specification of the device. The information on the basis weight of the sheet being conveyed can be acquired by reading by the control portion 360 of the information stored in the nonvolatile memory 251 (see FIG. 9) through the communication portion 26 (see FIG. 9).

If it is determined that the purge target sheet has a basis weight smaller than the reference value (NO at Step S14), the purge operation is performed (Step S19). The purge operation at Step S19 is an operation in which the rotation of the fifth and sixth conveying roller pairs 317 and 318 is stopped while the first to fourth conveying roller pairs 313 to 316 are continuously rotated, the first and second movable guide portions 34 and 35 are opened, and the sheet is ejected to the outside of the sheet conveying path 31. At the Step S19, the series of purge operations are performed without changing the magnitudes of the driving currents of the first and second stepping motors 365 and 366.

A rapid load is applied to a sheet in a direction opposite to the sheet conveying direction due to a rapid stop of the fifth conveying roller pair 317, but if the basis weight of the sheet is small, the load is absorbed by the sheet through buckling of the sheet or the like. Thus, since the load is difficult to be transmitted to the side of the first to fourth conveying roller pairs 313 to 316, out-of-step can be avoided without increasing the driving currents of the first and second stepping motors 365 and 366 during the purge operation. After that, the user executes the jamming processing for removing the jammed sheet and the remaining sheet (Step S17). As a result, the purge operation and the jamming processing at occurrence of jamming are finished.

If it is determined that the purge target sheet has the reference basis weight or more (YES at Step S14), the control portion 360 determines whether or not the length of the purge target sheet in the conveying direction is the length nipped by the upstream-side roller and the downstream-side roller of the sheet conveying device 30 at the same time (Step S15). Here, in the embodiment, the fourth conveying roller pair 316 of the intermediate conveying portion 310*b* corresponds to the upstream-side roller, and the fifth conveying roller pair 317 of the downstream-side conveying portion 310*c* corresponds to the downstream-side roller. The information on the length of the conveyed sheet can be acquired by reading by the control portion 360 of the information stored in the nonvolatile memory 251 (see FIG. 9) through the communication portion 26 (see FIG. 9).

If it is determined that the length of the purge target sheet in the conveying direction is not the length nipped by the upstream-side roller and the downstream-side roller of the sheet conveying device 30 at the same time (NO at Step S15), the purge operation is performed (Step S19). The purge operation is as described above. If the length of the purge target sheet in the conveying direction is not the length nipped by the upstream-side roller and the downstream-side roller of the sheet conveying device 30 at the same time, a load to the first and second stepping motors 365 and 366 involved with rotation stop of the fifth conveying roller pair 317 does not occur. That is because, even if the rotation of the fifth conveying roller pair 317 is stopped in the state in which the leading end of the sheet in the conveying direction is nipped by the fifth conveying roller pair 317, the rear end of the sheet in the conveying direction does not extend to the fourth conveying roller pair 316. Therefore, in such case, too, the out of step can be avoided without increasing the driving currents of the first and second stepping motors 365 and 366 during the purge operation. After that, the user executes the jamming processing for removing the jammed sheet and the remaining sheet (Step S17). As a result, the purge operation and the jamming processing at occurrence of jamming are finished.

If it is determined that the length of the purge target sheet in the conveying direction is the length nipped by the upstream-side roller and the downstream-side roller of the sheet conveying device 30 at the same time (YES at Step S15), the purge operation is performed (Step S16). The purge operation at the Step S16 is the same as the purge operation at Step S6 in FIG. 12, and the driving currents of the first and second stepping motors 365 and 366 are increased during the period (t2–t1) (see FIG. 13) in which the out of step of the first and second stepping motors 365 and 366 is concerned. In the embodiment, too, during the normal sheet conveyance, for example, the first and second stepping motors 365 and 366 were driven at 1.5 A and were driven at 2.3 A in the period (t2–t1). After that, the user executes the jamming processing for removing the jammed sheet and the remaining sheet (Step S17). As a result, the purge operation and the jamming processing at occurrence of jamming are finished.

As described above, only when the purge target sheet has the reference basis weight or more and the length of the purge target sheet in the sheet conveying direction is the length nipped by the upstream-side roller and the downstream-side roller at the same time, the purge operation with the increase in the driving currents of the first and second stepping motors 365 and 366 is performed. As a result, power consumption can be minimized.

In the embodiment, the basis weight of the purge target sheet is determined at Step S14, but it may be so configured that whether or not the rigidity of the purge target sheet is determined to be the reference value or more. If the rigidity of the sheet is high, the sheet is not buckled easily, and if the rotation of the downstream-side roller is stopped in the state nipped by the upstream-side roller and the downstream-side roller, a load is applied to the upstream-side roller side. In such case, the load is applied to the stepping motor driving the upstream-side roller and there is a concern of out of step. On the other hand, if the rigidity of the sheet is low, the sheet is buckled easily, and if the rotation of the downstream-side roller is stopped in the state nipped by the upstream-side roller and the downstream-side roller, the sheet is buckled, and a load is not applied to the upstream-side roller easily. Therefore, by increasing the driving currents of the first and second stepping motors 365 and 366 if the rigidity of the purge target sheet is at the reference value or more, out of step of the first and second stepping motors 365 and 366 can be prevented.

3. Third Embodiment

Image Forming Apparatus

Figure 15:
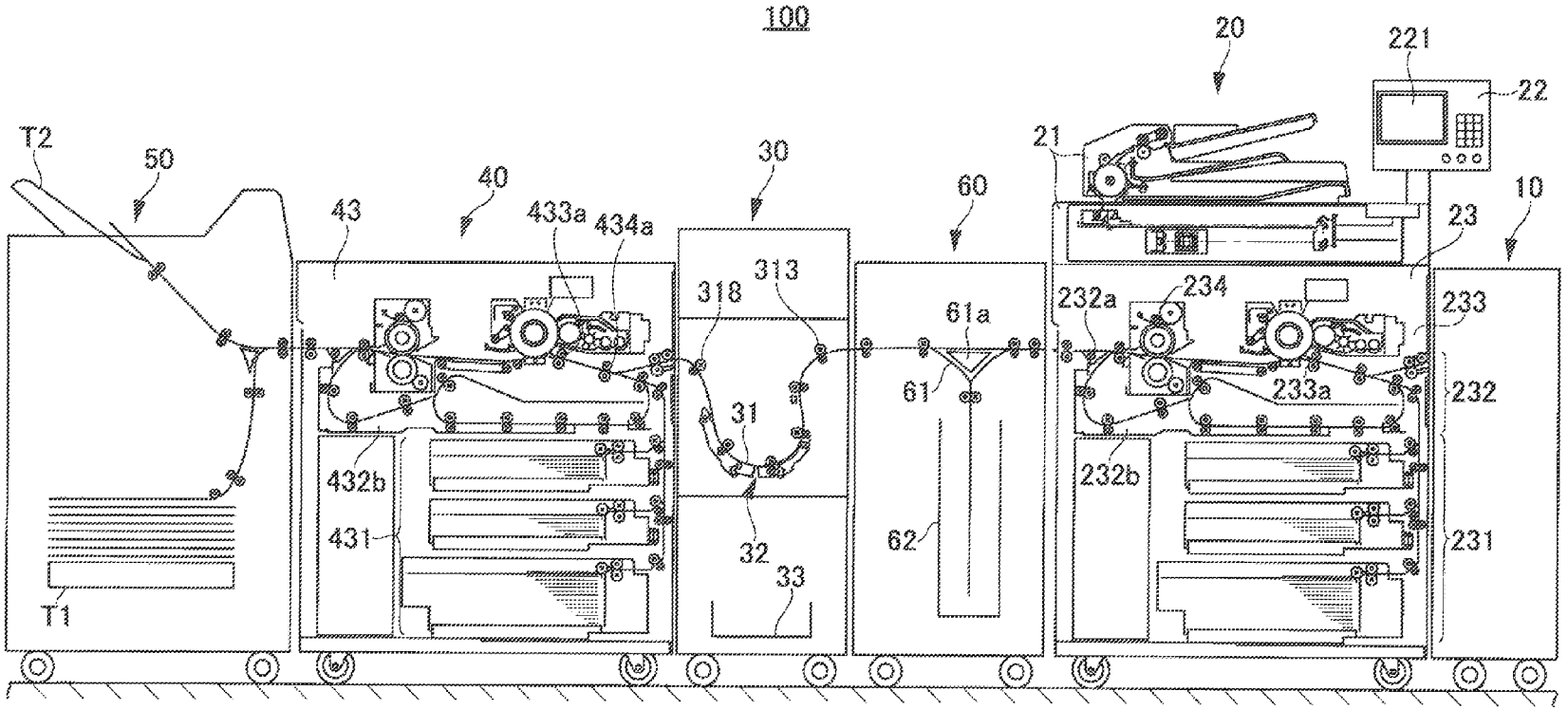
FIG. 15 is an outline view illustrating an entire configuration of an image forming system according to a third embodiment.

FIG. 15 is an outline view illustrating an entire configuration of an image forming system 100 according to a third embodiment of the present invention. In FIG. 15, the same reference numerals are given to the portions corresponding to those in FIG. 1, and duplicated explanation will be omitted.

In the image forming system 100 illustrated in FIG. 15, an intermediate device 60 is arranged between the first image forming apparatus 20 and the sheet conveying device 30. That is, the intermediate device 60 is arranged on the downstream side of the first image forming apparatus 20 and on the upstream side of the sheet conveying device 30 in the sheet conveying direction. In the embodiment, the intermediate device 60 conveys the sheet conveyed from the first image forming apparatus 20 to the sheet conveying device 30 in accordance with the instruction from the first image forming apparatus 20.

The intermediate device 60 includes an inverting portion 61 having a conveying path switching portion 61*a*, an inverting roller and the like, a stack portion 62 and the like for storing (stacking) the sheet on which an image has been formed.

If the front and rear of the sheet to be conveyed to the sheet conveying device 30 needs to be inverted, the sheet conveyed from the first image forming apparatus 20 is conveyed to the inverting portion 61 by a switching operation of the conveying path switching portion 61*a*, and the sheet is switched back by the inverting roller of the inverting portion 61, whereby the front and rear of the sheet is inverted and is conveyed to the sheet conveying device 30.

If the front and rear of the sheet does not have to be inverted, the sheet conveyed from the first image forming apparatus 20 is not conveyed to the inverting portion 61 by the switching operation of the conveying path switching portion 61*a* and is conveyed to the sheet conveying device 30 without inverting the front and rear of the sheet.

Moreover, if the sheet conveyed from the first image forming apparatus 20 needs to be temporarily stored, the sheet conveyed from the first image forming apparatus 20 is temporarily stored in the stack portion 62. The intermediate device 60 may include a sheet ejection tray for ejecting the sheet conveyed from the first image forming apparatus 20.

The embodiments to which the invention made by the inventor is applied have been described. However, the present invention is not limited by the description and the drawings forming a part of the disclosure of the invention according to the above-described embodiments but is capable of various variations in practice within a range not departing the gist of the invention described in the claims.

In the above-described embodiments, the serial tandem type image forming system 1 constituted by the first and second image forming apparatuses 20 and 40 has been described, but a serial tandem type image forming system may be constituted by using three or more image forming apparatuses. In such case, among the plurality of image forming apparatuses constituting the image forming system, it is assumed that the image forming apparatus provided on the most upstream side in the sheet conveying direction is set as a main machine, and the image forming apparatuses excluding the main machine are set as sub machines.

In the above-described embodiments, the configuration in which the automatic path opening mechanism 32 includes the first movable guide portion 34 and the second movable guide portion 35 has been described, but the first movable guide portion 34 and the second movable guide portion 35 may be constituted integrally.

What is claimed is:

1. A sheet conveying device comprising:

a plurality of conveying roller pairs provided along a sheet conveying path, including a downstream-side conveying roller pair whose rotation is stopped at occurrence of jamming and an upstream-side conveying roller pair provided on an upstream side of the downstream-side conveying roller pair and continuously rotating at the occurrence of jamming;

a movable guide portion for opening a sheet conveying path by moving one of rollers of at least the downstream-side conveying roller pair in the plurality of conveying roller pairs in a direction away from the sheet conveying path; and a control portion for executing control such that rotation of the downstream-side conveying roller pair in the plurality of conveying roller pairs is stopped at the occurrence of jamming and a conveying force for conveying a sheet of a stepping motor driving the upstream-side conveying roller pair becomes larger than the conveying force before the rotation of the downstream-side conveying roller pair is stopped.

2. The sheet conveying device according to claim 1, wherein the control portion controls the conveying force by changing a driving current for driving the stepping motor.

3. The sheet conveying device according to claim 1, wherein the control portion stops the rotation of the downstream-side conveying roller pair and then, moves the movable guide portion so as to move one of the rollers of the downstream-side conveying roller pair in the direction away from the sheet conveying path, and releases pressure contact of the downstream-side conveying roller pair.

4. The sheet conveying device according to claim 1, wherein the control portion executes control such that at least until the pressure contact of the downstream-side conveying roller pair is released from stop of the rotation of the downstream-side conveying roller pair, the conveying force of the stepping motor becomes larger than the conveying force before the rotation of the downstream-side conveying roller pair is stopped.

5. The sheet conveying device according to claim 1, wherein the control portion controls the stepping motor so that if the sheet being conveyed has a length nipped by the downstream-side conveying roller pair and the upstream-side conveying roller pair at the same time, the conveying force of the stepping motor becomes larger than the conveying force before the rotation of the downstream-side conveying roller pair is stopped.

6. The sheet conveying device according to claim 1, wherein the control portion controls the stepping motor so that if a basis weight of the sheet being conveyed is at a reference value or more, the conveying force of the stepping motor becomes larger than the conveying force before the rotation of the downstream-side conveying roller pair is stopped.

7. The sheet conveying device according to claim 1, wherein the control portion controls the stepping motor so that rigidity of the sheet being conveyed is detected, and if the rigidity is at a reference value or more, the conveying force of the stepping motor becomes larger than the conveying force before the rotation of the downstream-side conveying roller pair is stopped.

8. An image forming system, comprising:

a first image forming apparatus arranged on an upstream side in a sheet conveying direction;

a second image forming apparatus arranged on a downstream side in the sheet conveying direction; and a sheet conveying device arranged between the first image forming apparatus and the second image forming apparatus and conveying a sheet conveyed from the first image forming apparatus to the second image forming apparatus, wherein the sheet conveying device includes:

a plurality of conveying roller pairs provided along a sheet conveying path, including a downstream-side conveying roller pair whose rotation is stopped at occurrence of jamming and an upstream-side conveying roller pair provided on an upstream side of the downstream-side conveying roller pair and continuously rotating at the occurrence of jamming;

a movable guide portion for opening a sheet conveying path by moving one of rollers of at least the downstream-side conveying roller pair in the plurality of conveying roller pairs in a direction away from the sheet conveying path; and a control portion for executing control such that rotation of the downstream-side conveying roller pair in the plurality of conveying roller pairs is stopped at the occurrence of jamming and a conveying force for conveying a sheet of a stepping motor driving the upstream-side conveying roller pair becomes larger than the conveying force before the rotation of the downstream-side conveying roller pair is stopped.

9. The image forming system according to claim 8, wherein the control portion controls the conveying force by changing a driving current for driving the stepping motor.

10. The image forming system according to claim 8, wherein the control portion stops the downstream-side conveying roller pair and then, moves the movable guide portion so as to move one of the rollers of the downstream-side conveying roller pair in the direction away from the sheet conveying path, and releases pressure contact of the downstream-side conveying roller pair.

11. The image forming system according to claim 8, wherein the control portion executes control such that at least until the pressure contact of the downstream-side conveying roller pair is released from stop of the rotation of the downstream-side conveying roller pair, the conveying force of the stepping motor becomes larger than the conveying force before the rotation of the downstream-side conveying roller pair is stopped.

12. The image forming system according to claim 8, wherein the control portion controls the stepping motor so that if the sheet being conveyed has a length nipped by the downstream-side conveying roller pair and the upstream-side conveying roller pair at the same time, the conveying force of the stepping motor becomes larger than the conveying force before the rotation of the downstream-side conveying roller pair is stopped.

13. The image forming system according to claim 8, wherein the control portion controls the stepping motor so that if a basis weight of the sheet being conveyed is at a reference value or more, the conveying force of the stepping motor becomes larger than the conveying force before the rotation of the downstream-side conveying roller pair is stopped.

14. The image forming system according to claim 8, wherein the control portion controls the stepping motor so that rigidity of the sheet being conveyed is detected, and if the rigidity is at a reference value or more, the conveying force of the stepping motor becomes larger than the conveying force before the rotation of the downstream-side conveying roller pair is stopped.

15. A control method of a sheet conveying device provided with:

a plurality of conveying roller pairs provided along a sheet conveying path, including a downstream-side conveying roller pair and an upstream-side conveying roller pair provided on an upstream side of the downstream-side conveying roller pair:

a movable guide portion for opening a sheet conveying path by moving one of rollers of at least the downstream-side conveying roller pair in the plurality of conveying roller pairs in a direction away from the sheet conveying path; and a control portion for controlling driving of the plurality of conveying roller pairs, wherein the control portion stops rotation of the downstream-side conveying roller pair in the plurality of conveying roller pairs at occurrence of jamming and executes control such that a conveying force for conveying a sheet of a stepping motor driving the upstream-side conveying roller pair becomes larger than the conveying force before the rotation of the downstream-side conveying roller pair is stopped.

16. The control method of a sheet conveying device according to claim 15, wherein the control portion controls the conveying force by changing a driving current for driving the stepping motor.

17. The control method of a sheet conveying device according to claim 15, wherein the control portion stops rotation of the downstream-side conveying roller pair and then, moves the movable guide portion so as to move one of the rollers of the downstream-side conveying roller pair in the direction away from the sheet conveying path, and releases pressure contact of the downstream-side conveying roller pair.

18. The control method of a sheet conveying device according to claim 15, wherein the control portion executes control such that at least until the pressure contact of the downstream-side conveying roller pair is released from stop of the rotation of the downstream-side conveying roller pair, the conveying force of the stepping motor becomes larger than the conveying force before the rotation of the downstream-side conveying roller pair is stopped.

19. The control method of a sheet conveying device according to claim 15, wherein the control portion controls the stepping motor so that if the sheet being conveyed has a length nipped by the downstream-side conveying roller pair and the upstream-side conveying roller pair at the same time, the conveying force of the stepping motor becomes larger than the conveying force before the rotation of the downstream-side conveying roller pair is stopped.

20. The control method of a sheet conveying device according to claim 15, wherein the control portion controls the stepping motor so that if a basis weight of the sheet being conveyed is at a reference value or more, the conveying force of the stepping motor becomes larger than the conveying force before the rotation of the downstream-side conveying roller pair is stopped.

21. The control method of a sheet conveying device according to claim 15, wherein the control portion controls the stepping motor so that rigidity of the sheet being conveyed is detected, and if the rigidity is at a reference value or more, the conveying force of the stepping motor becomes larger than the conveying force before the rotation of the downstream-side conveying roller pair is stopped.

* * * * *